United States Patent [19]

Wiegers et al.

[11] Patent Number: 4,524,783

[45] Date of Patent: Jun. 25, 1985

[54] ALKANOIC ACID ESTERS OF 3,4,5,6,6-PENTAMETHYL HEPTANOL-2 AND ALKYL HOMOLOGUES THEREOF; PROCESS FOR PREPARING SAME AND ORGANOLEPTIC USES THEREOF

[75] Inventors: Wilhelmus J. Wiegers, Red Bank; Ronald S. Fenn, New Providence; Richard M. Boden, Ocean; William L. Schreiber, Jackson, all of N.J.

[73] Assignee: International Flavors & Fragrances Inc., New York, N.Y.

[21] Appl. No.: 589,498

[22] Filed: Apr. 26, 1984

Related U.S. Application Data

[62] Division of Ser. No. 541,261, Oct. 12, 1983, abandoned, which is a division of Ser. No. 405,611, Aug. 5, 1982, abandoned.

[51] Int. Cl.[3] ..... A24B 3/14

[52] U.S. Cl. ..... 131/276

[58] Field of Search ..... 131/276

*Primary Examiner*—V. Millin

*Attorney, Agent, or Firm*—Arthur L. Liberman

[57] ABSTRACT

Described is the novel compound genus defined according to the structure:

wherein $R_1$ is selected from the group consisting of $C_1$–$C_3$ alkyl and $R_2$ is selected from the group consisting of hydrogen and $C_1$–$C_3$ alkyl; useful in augmenting or enhancing the aroma or taste of consumable materials including perfumes, colognes, perfumed articles (including solid or liquid anionic, cationic, nonionic or zwitterionic detergents, perfumed polymers), smoking tobacco and smoking tobacco articles.

7 Claims, 30 Drawing Figures

GLC PROFILE FOR BULKED FRACTIONS 4-7 OF EXAMPLE II.

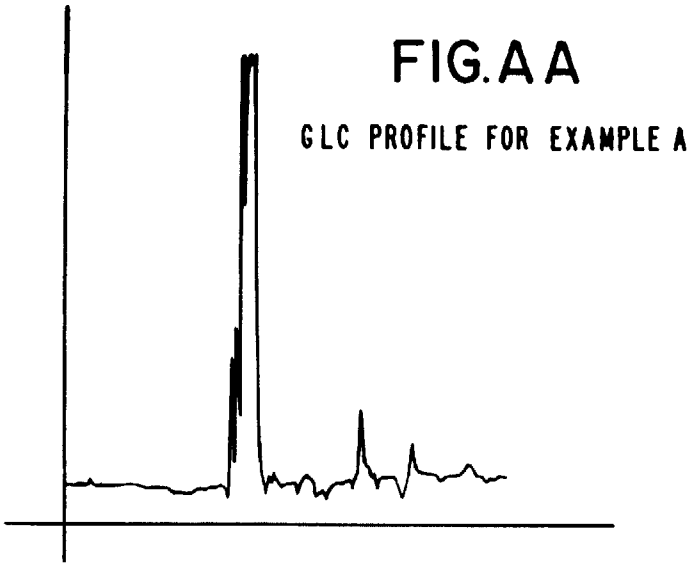
FIG. AA
GLC PROFILE FOR EXAMPLE A
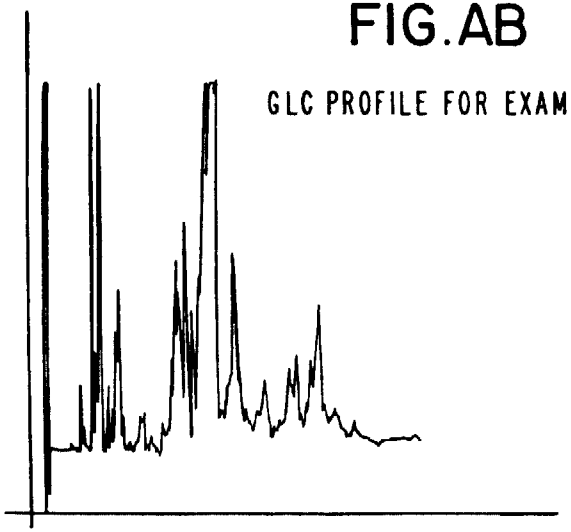
FIG. AB
GLC PROFILE FOR EXAMPLE A
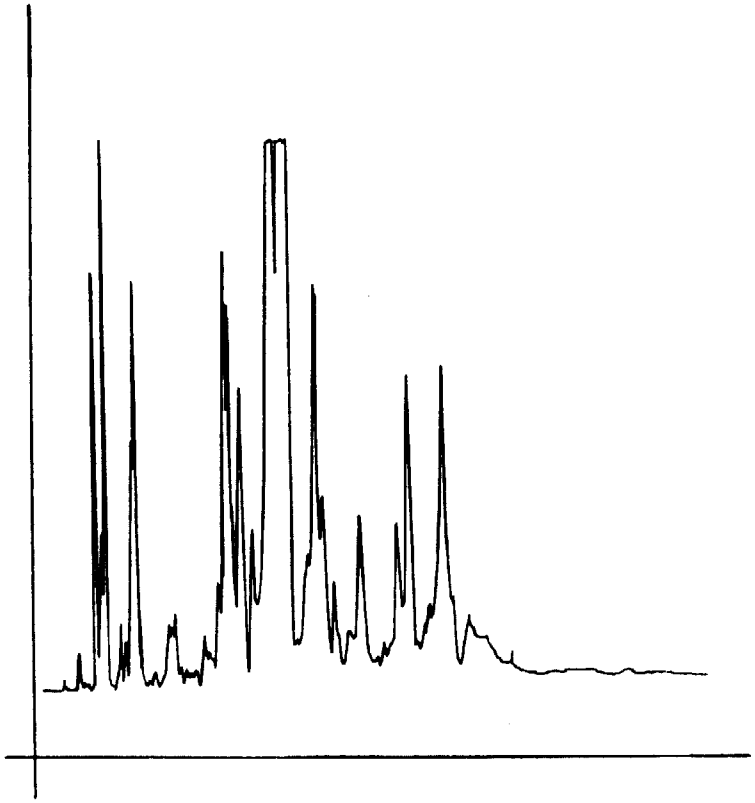
FIG. AC
GLC PROFILE FOR EXAMPLE A.

FIG.AE
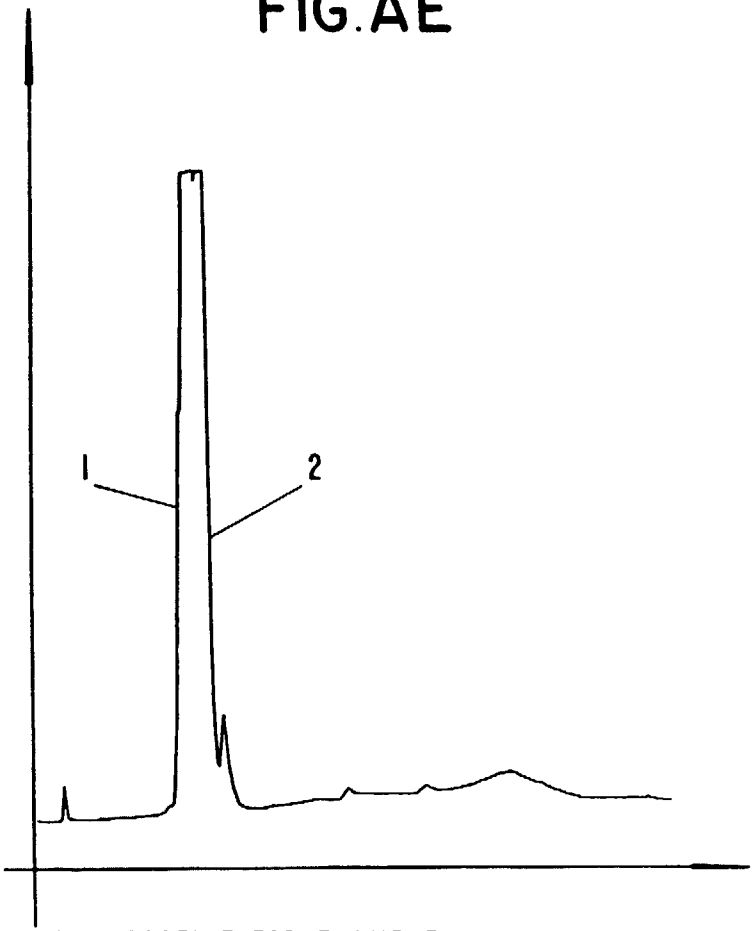
GLC PROFILE FOR EXAMPLE A.
DISTILLATION PRODUCT
FIG.AD
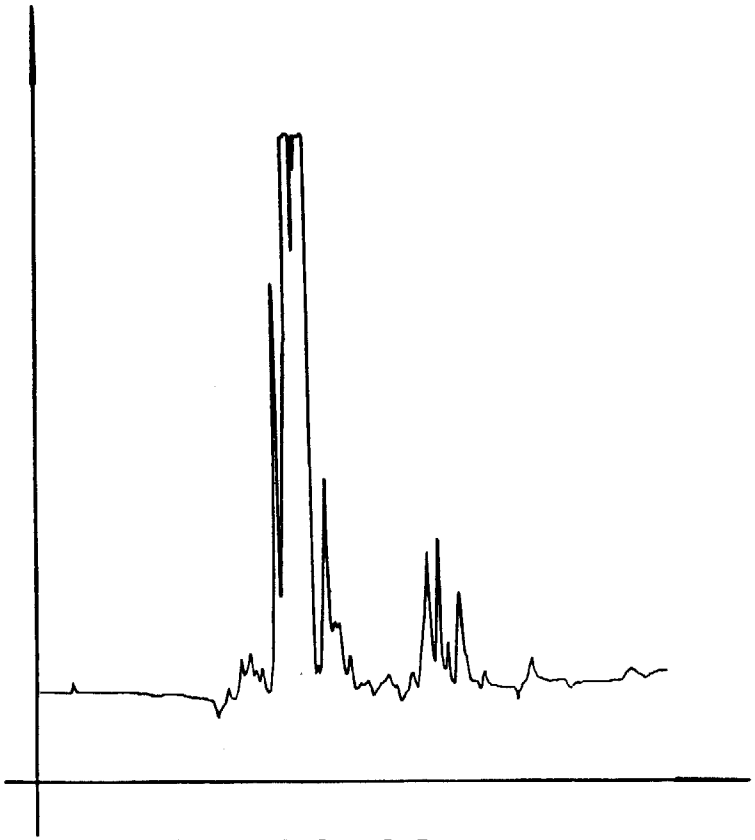
GLC PROFILE FOR EXAMPLE A
CRUDE PRODUCT FIG.BA
NMR SPECTRUM FOR PEAK I OF EXAMPLE A, OF GLC OF FIG.AE
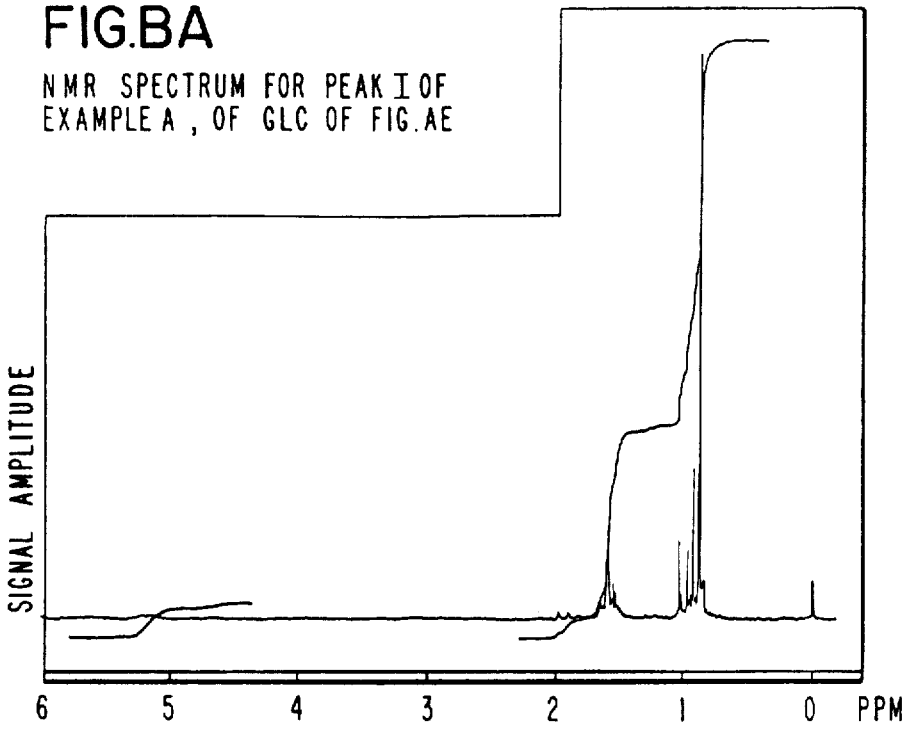
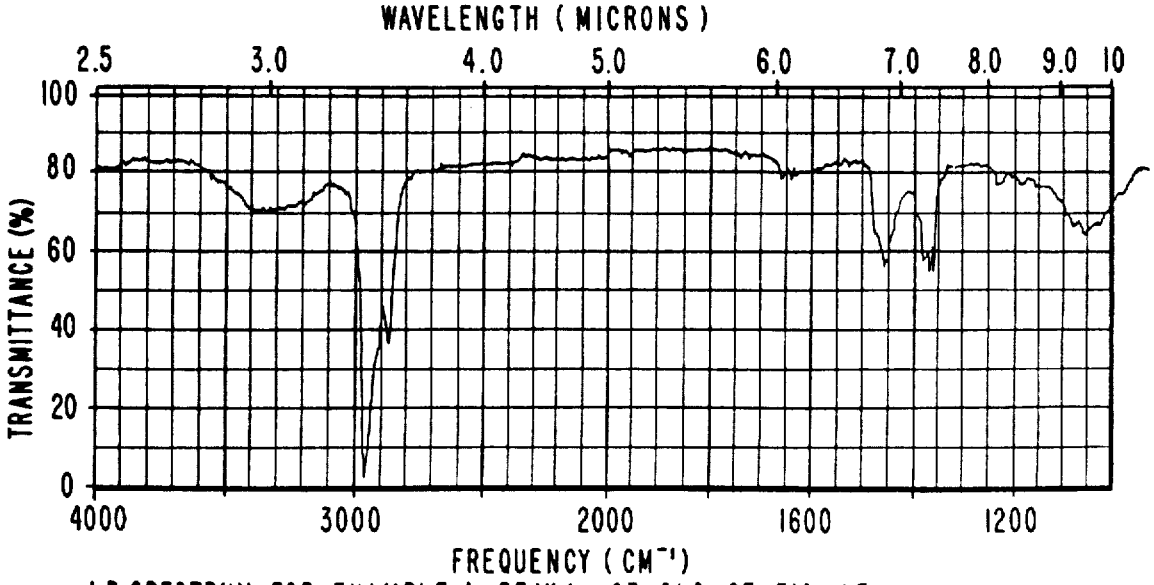
IR SPECTRUM FOR EXAMPLE A, PEAK I, OF GLC OF FIG. AE.
FIG.BB FIG.CA
NMR SPECTRUM FOR EXAMPLE A, PEAK 2, OF GLC OF FIG. AE
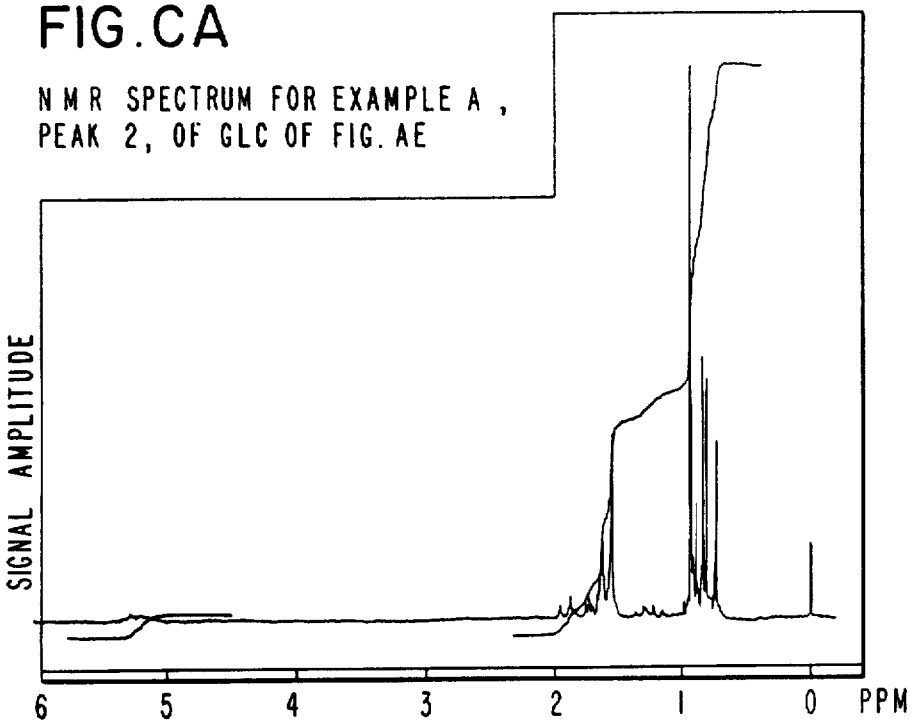
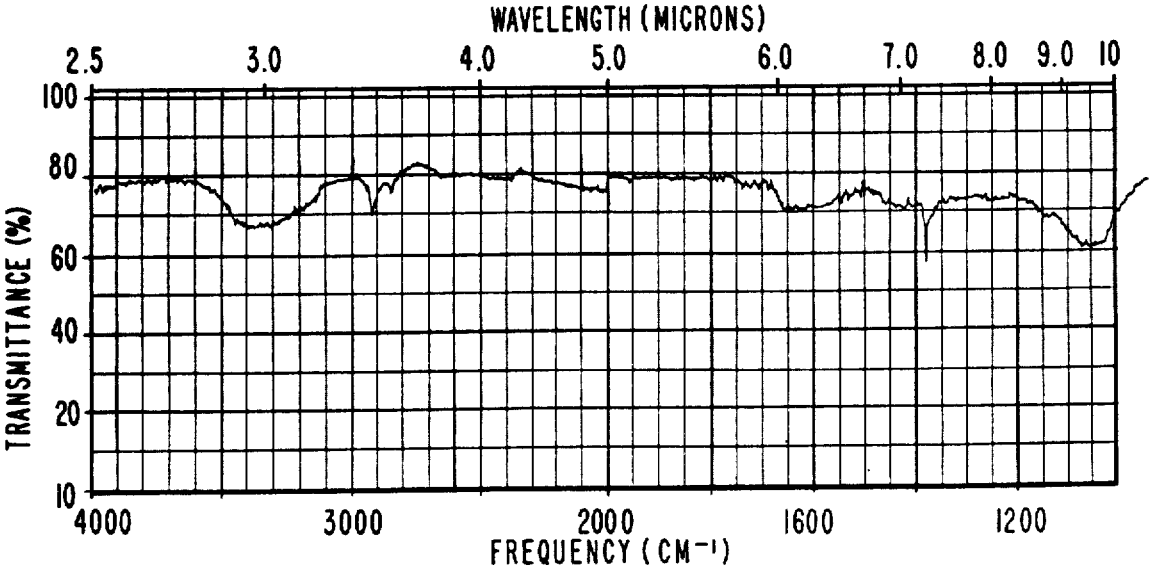
IR SPECTRUM FOR EXAMPLE I, PEAK 2 OF GLC OF FIG. AE
FIG.CB FIG. D
N M R SPECTRUM FOR PEAK 2 OF EXAMPLE I, OF GLC OF FIG. AB.
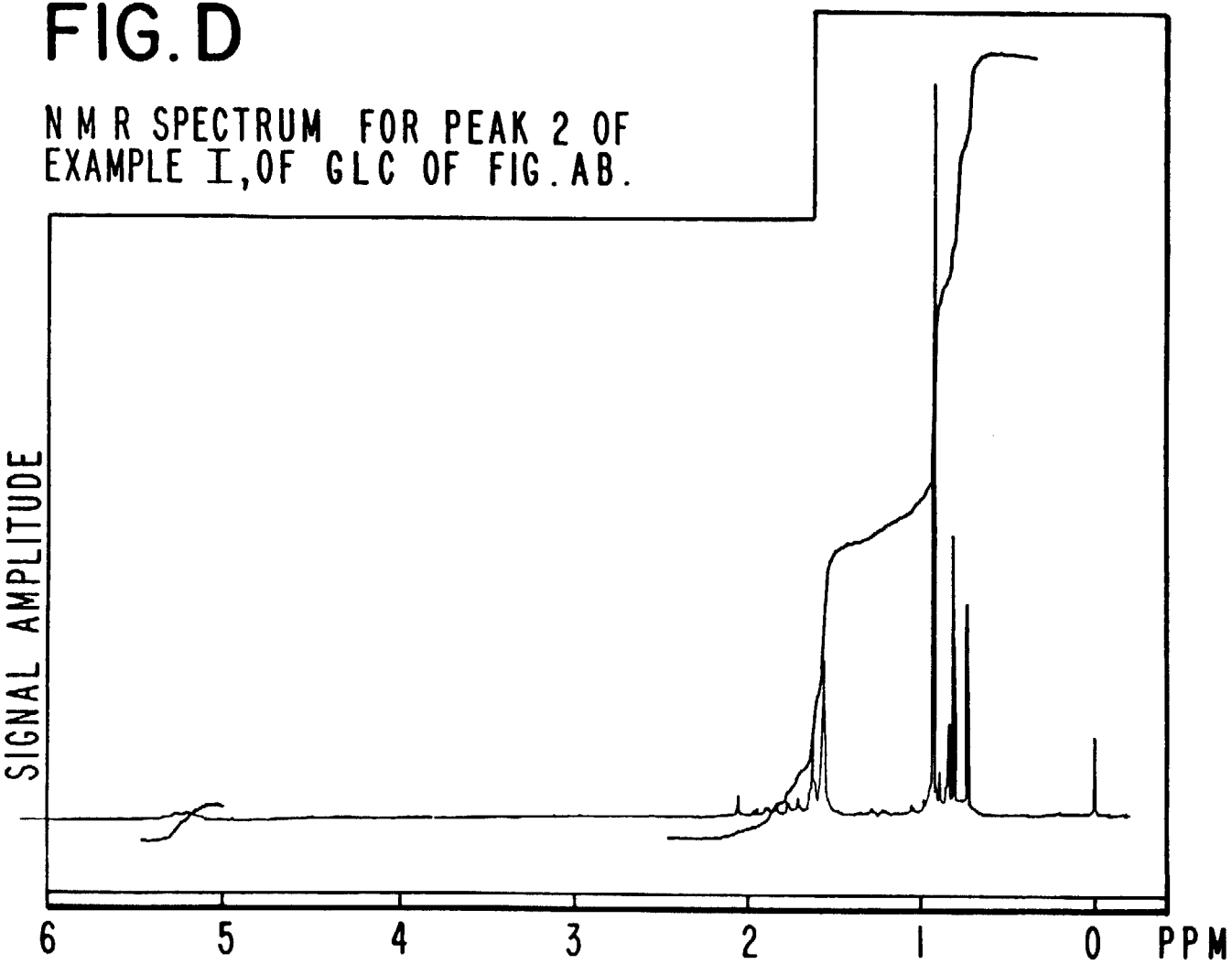

GLC PROFILE FOR EXAMPLE I.

IR SPECTRUM FOR PEAK 3 OF EXAMPLE I.

IR SPECTRUM FOR PEAK 4 OF EXAMPLE I.

IR SPECTRUM FOR PEAK 5 OF EXAMPLE I.

IR SPECTRUM FOR PEAK 6 OF EXAMPLE I.

IR SPECTRUM FOR PEAK 7 OF EXAMPLE I.

IR SPECTRUM FOR PEAK 8 OF EXAMPLE I.

IR SPECTRUM FOR PEAK 9 OF EXAMPLE I.

IR SPECTRUM FOR PEAK 10 OF EXAMPLE I.

NMR SPECTRUM FOR EXAMPLE I.

GLC PROFILE FOR EXAMPLE II. CRUDE

GLC PROFILE FOR BULKED FRACTIONS 4-7 OF EXAMPLE II.

GLC PROFILE FOR BULKED FRACTIONS 12-15 OF EXAMPLE III.

I R SPECTRUM FOR BULKED FRACTIONS 12-15 OF EXAMPLE II.

GLC PROFILE FOR FRACTION 8
OF EXAMPLE IV.

NMR SPECTRUM FOR FRACTION 8 OF EXAMPLE IV.

IR SPECTRUM FOR FRACTION 8 OF EXAMPLE IV.

ALKANOIC ACID ESTERS OF 3,4,5,6,6-PENTAMETHYL HEPTANOL-2 AND ALKYL HOMOLOGUES THEREOF; PROCESS FOR PREPARING SAME AND ORGANOLEPTIC USES THEREOF

This is a divisional of application Ser. No. 541,261, filed 10/12/83 now abandoned, which, in turn, is a divisional of United States Letters Patent, Ser. No. 405,611 filed 8/5/82 now abandoned.

BACKGROUND OF THE INVENTION

Materials which can provide warm, sweet, woody, ambery, floral, piney, fruity and musky aroma nuances with ionone-like undertones, particularly those materials which are relatively inexpensive, are highly sought after in the art of perfumery. Many of the natural materials which provide such fragrance profiles and contribute desired nuances to perfumery compositions and perfumed article substances are high in cost, vary in quality from one batch to another and/or are generally subject to the usual variations of natural products.

There is, accordingly, a continuing effort to find synthetic materials which will replace the essential fragrance notes produced by natural essential oils or compositions thereof. Unfortunately, many of these synthetic materials either have the desired nuances only to a relatively small degree or else contribute undesirable or unwanted odor to the composition. The search for materials which can provide a more refined warm, sweet, woody, ambery, floral, piney, fruity and musky aroma profile with ionone-like undertones has been difficult and relatively costly in the areas of both natural products and synthetic products.

Materials which can provide woody and oriental aroma and taste profiles both prior to and on smoking in the main stream and the side streams of smoking tobacco articles are desirable for augmenting or enhancing the aroma or taste of smoking tobacco and smoking tobacco articles, e.g. cigarettes and cigars.

Even more desirable is a product that can serve to substitute for difficult-to-obtain natural perfumery oils and expensive synthetic ingredients of perfume compositions and, at the same time, substitute for expensive flavoring ingredients in smoking tobacco and in smoking tobacco articles.

Perfumery materials which are inexpensive such as dihydro linalool (3,7-dimethyl-6-octen-3-ol) and dihydro myrcenol (3-methylene-7-methyloctanol-7) do not provide the vetiverlike fragrance profiles that are provided by the more expensive, more complex molecules such as vetivone.

Dihydro linalool according to "Perfume and Flavor Chemicals (Aroma Chemicals)" by Steffen Arctander (1969) having the structure:

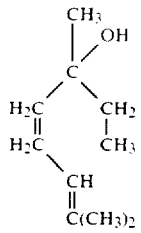

at Monograph 960 is indicated to have a fresh, floral, citrusy aroma which is less woody than linalool and more powerful and more lime-like than tetrahydro linalool. On the other hand, dihydro myrcenol having the structure:

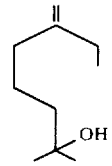

(at number 964 of Arctander) is described as being powerful, fresh lime-like, overall citrusy, floral and sweet with little or no terpenic undertones. Dihydro myrcenyl acetate described at Monograph 965 of Arctander having the structure:

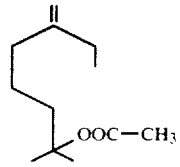

is described as sweet, spicy, herbaceous, fresh and somewhat fruity with a bergamot-like character but poor tenacity.

The chemicals described in the prior art such as dihydro myrcenyl acetate, dihydro myrcenol or dihydro linalool have aroma profiles or chemical structures which are not even remotely similar to the compounds of our invention.

BRIEF DESCRIPTION OF THE DRAWINGS

FIG. AA represents the GLC profile for the reaction product of Example A using a 70% sulfuric acid catalyst at 35° C.

FIG. AB represents the GLC profile for the reaction product of Example A using an Amberlyst ®15 acidic ion exchange resin catalyst at a temperature of 150° C.

FIG. AC represents the GLC profile for the reaction product of Example A, using an Amberlyst ®15 catalyst at 100° C.

FIG. AD represents the GLC profile for the reaction product of Example A, using a sulfuric acid catalyst and an alpha-methylstyrene diluent at 35° C. according to the conditions of United Kingdom Patent Specification No. 796,130 (crude reaction product).

FIG. AE represents the GLC profile for the reaction product of Example A, using a sulfuric acid catalyst, at 35° C. and an alpha-methyl styrene diluent according to the conditions of United Kingdom Patent Specification No. 796,130 (distilled reaction product) (boiling range 36°-38° C. at 4-5 mm HG pressure).

FIG. BA represents the NMR spectrum for Peak 1 of the GLC profile of FIG. AE.

FIG. BB represents the infra-red spectrum for Peak 1 of the GLC profile of FIG. AE.

FIG. CA represents the NMR spectrum for Peak 2 of the GLC profile of FIG. AE.

FIG. CB represents the infra-red spectrum for Peak 2 of the GLC profile of FIG. AE.

FIG. D represents the NMR spectrum for Peak 2 of the GLC profile of FIG. AB.

Figure 1:
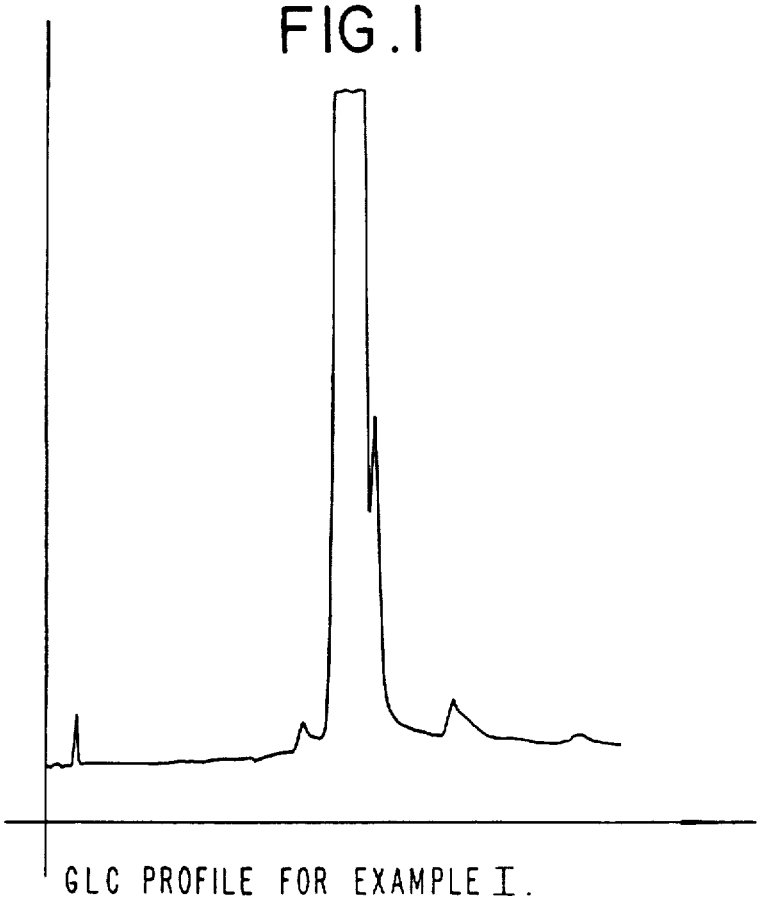

FIG. 1 sets forth the GLC profile for the reaction product of Example I, containing compounds defined according to the structure:

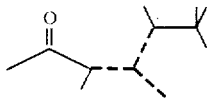

wherein in each molecule of the mixture, one of the dashed lines is a carbon-carbon double bond and the other of the dashed lines are carbon-carbon single bonds.

Figure 2A:
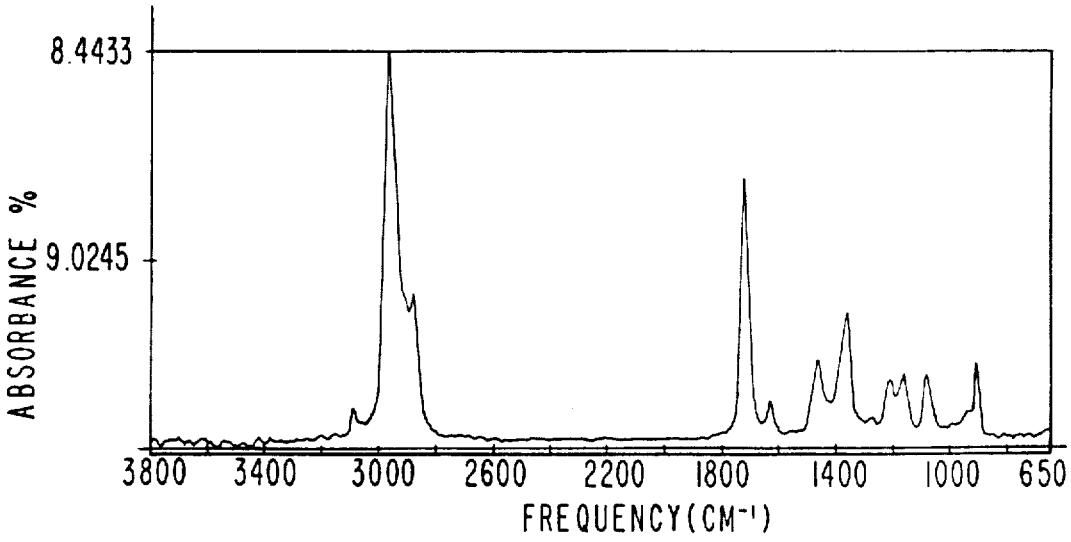

FIG. 2A represents the infra-red spectrum for Peak 3 of the GLC profile of FIG. 1.

Figure 2B:
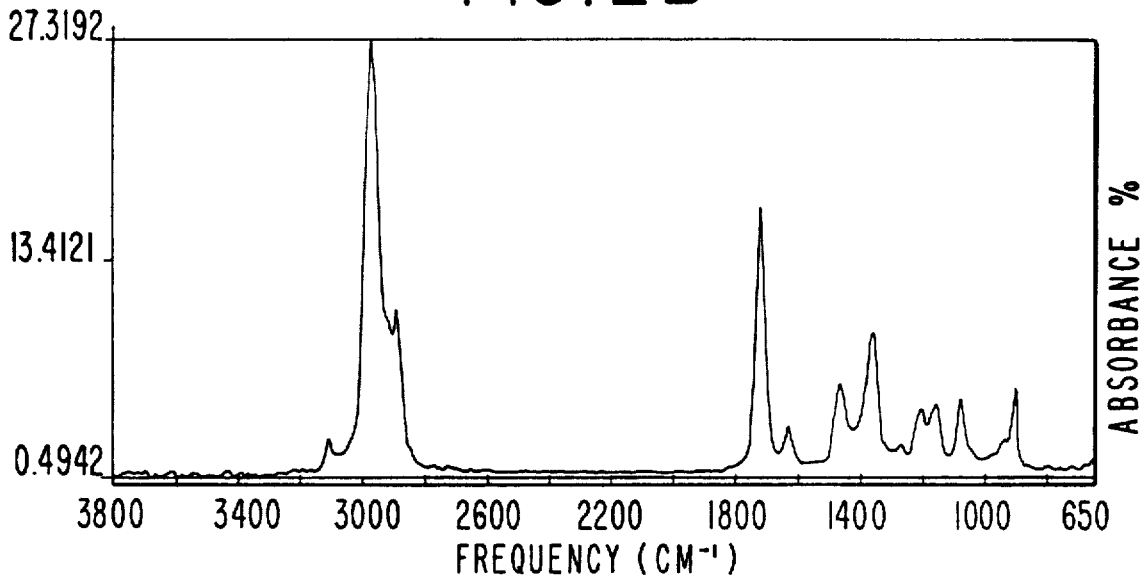

FIG. 2B represents the infra-red spectrum of Peak 4 of the GLC profile of FIG. 1.

Figure 2C:
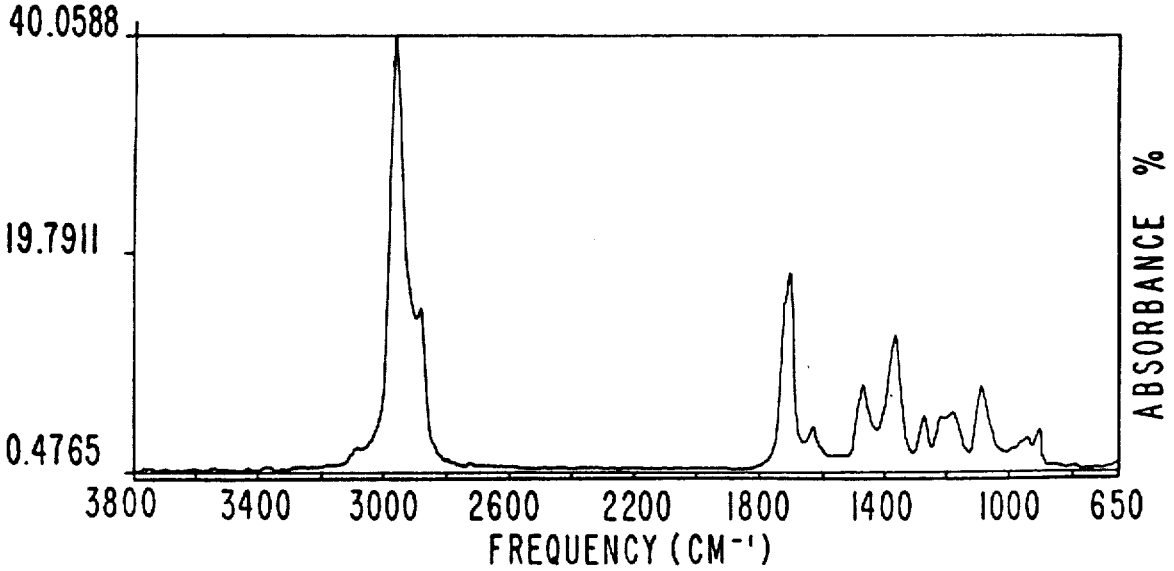

FIG. 2C represents the infra-red spectrum for Peak 5 of the GLC profile of FIG. 1.

Figure 2D:
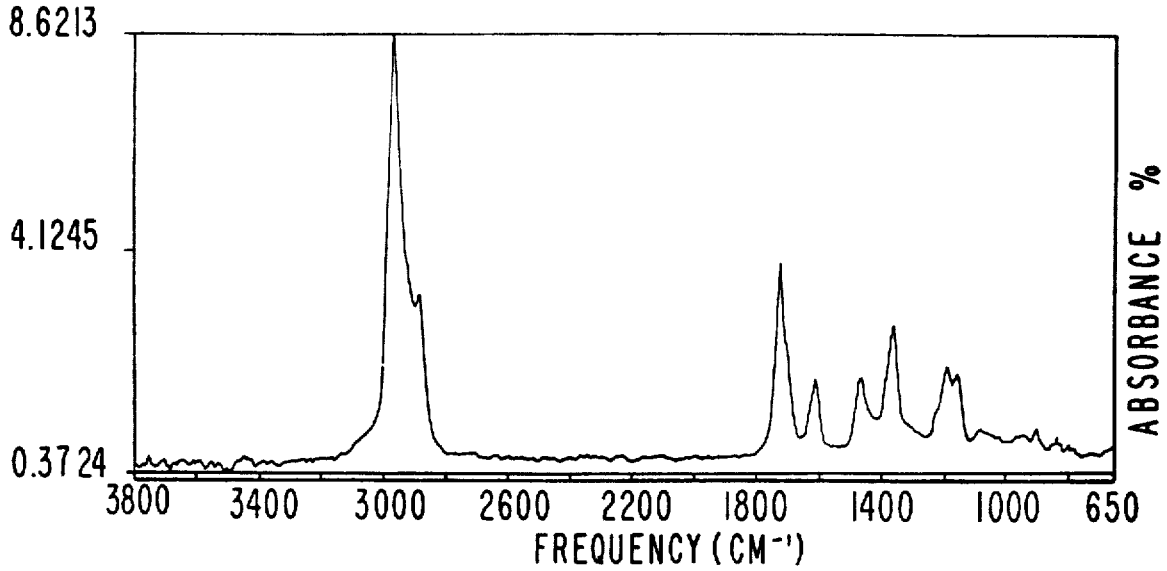

FIG. 2D represents the infra-red spectrum for Peak 6 of the GLC profile of FIG. 1.

Figure 2E:
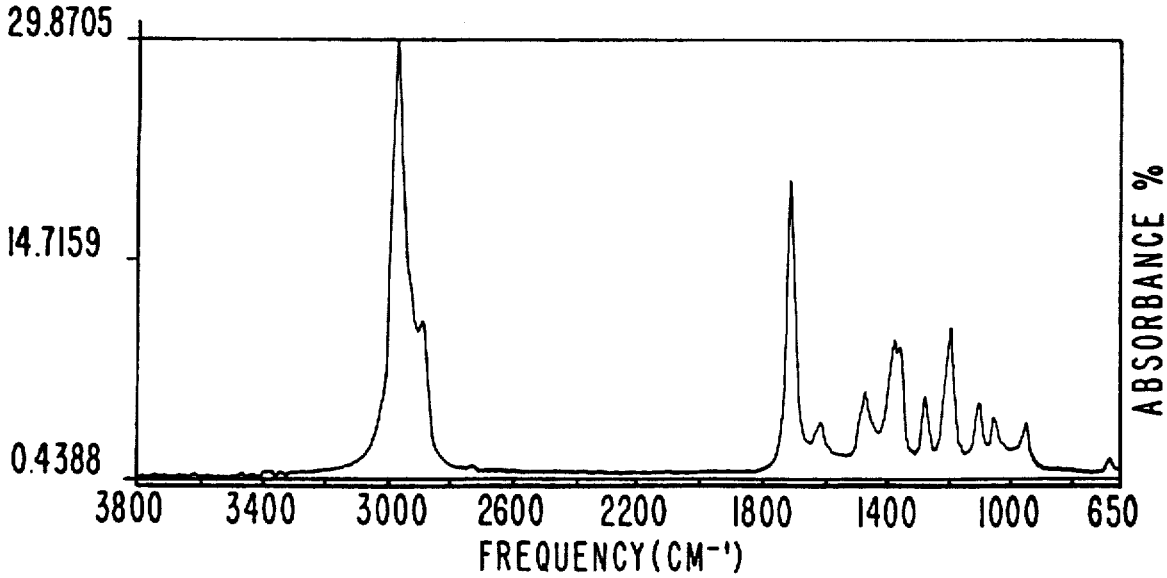

FIG. 2E represents the infra-red spectrum for Peak 7 of the GLC profile of FIG. 1.

Figure 2F:
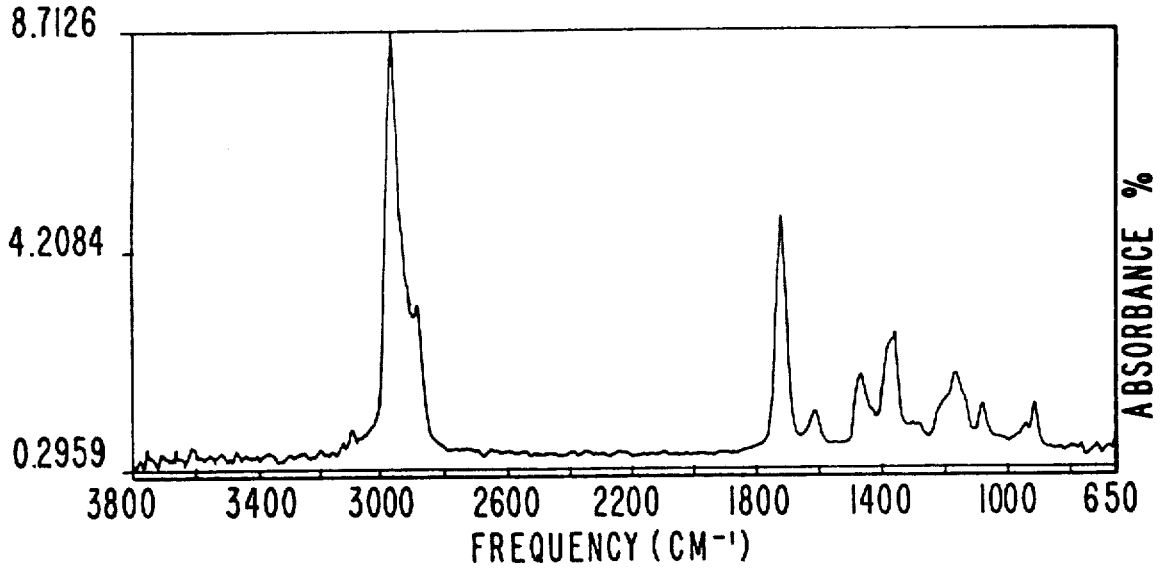

FIG. 2F represents the infra-red spectrum for Peak 8 of the GLC profile of FIG. 1.

Figure 2G:
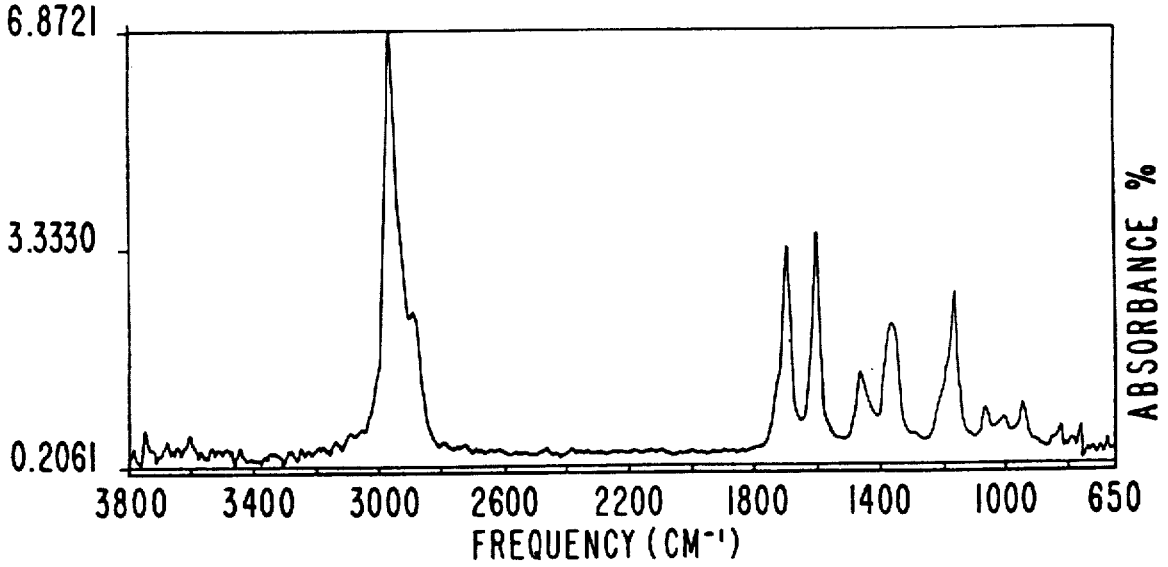

FIG. 2G represents the infra-red spectrum for Peak 9 of the GLC profile of FIG. 1.

Figure 2H:
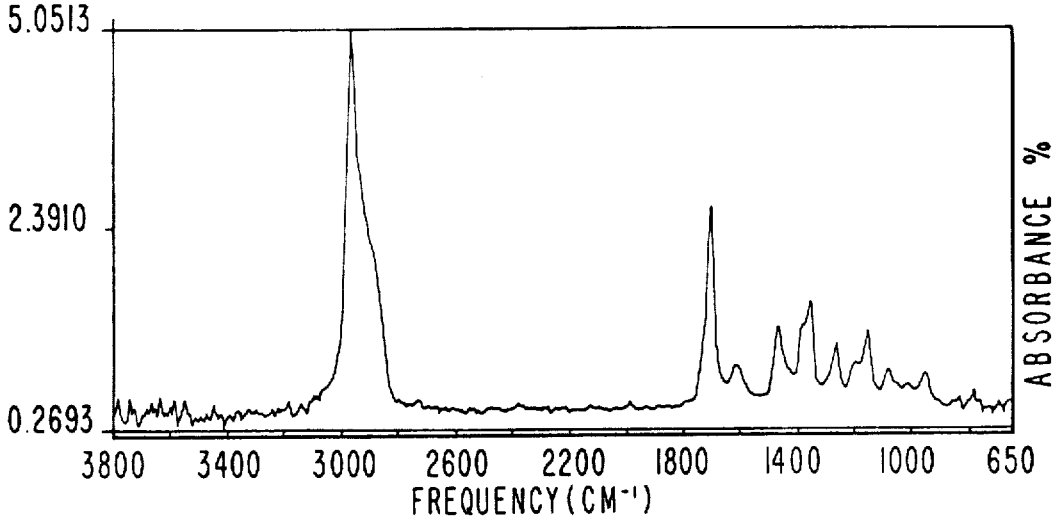

FIG. 2H represents the infra-red spectrum for Peak 10 of the GLC profile of FIG. 1.

Figure 2J:
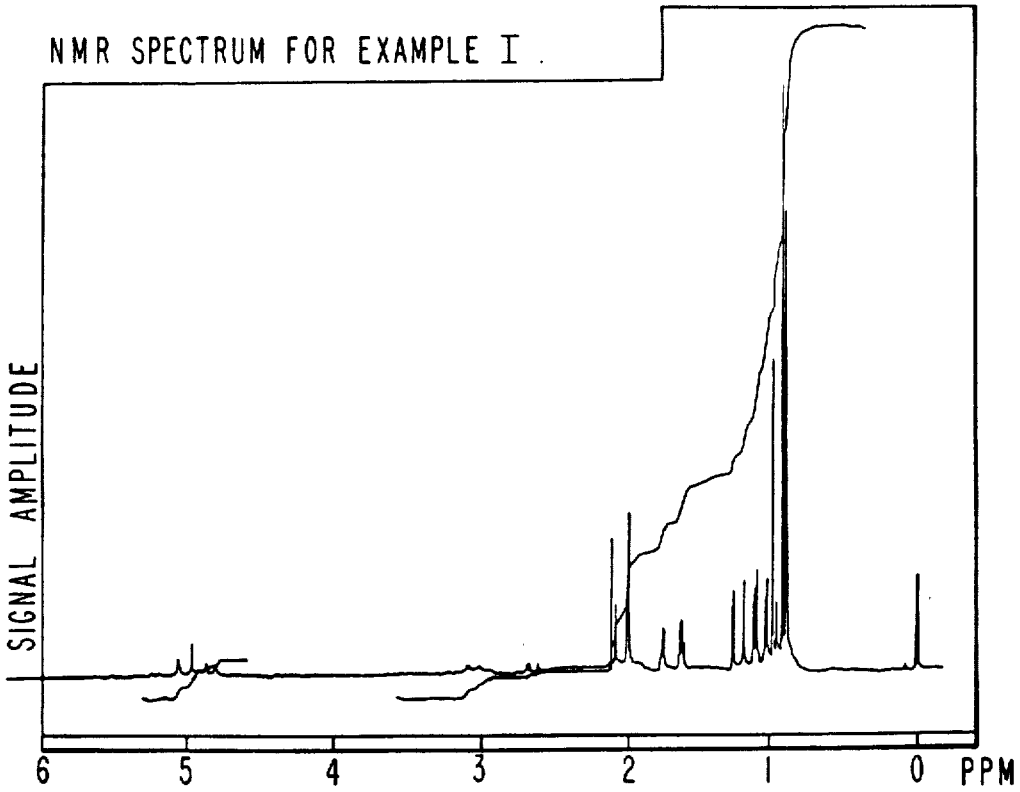

FIG. 2J represents the NMR spectrum for a mixture of compounds having the structures:

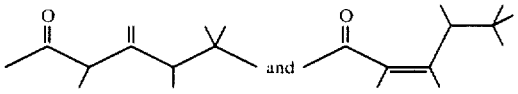

produced according to Example I.

Figure 2K:
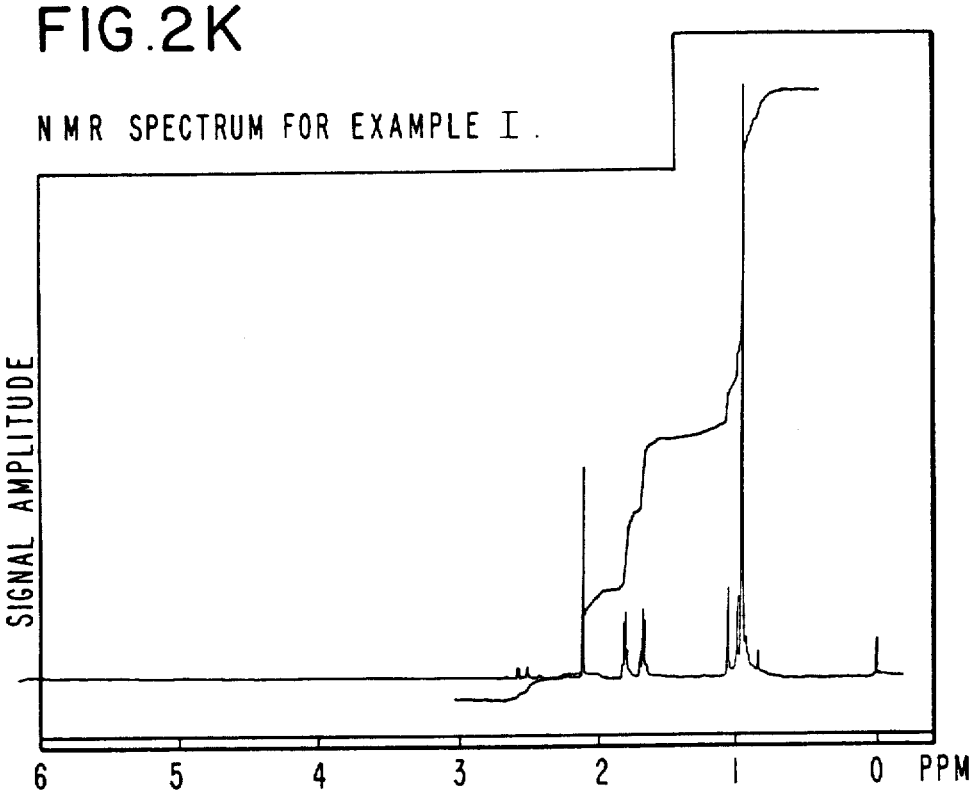

FIG. 2K represents the NMR spectrum for the compound having the structure:

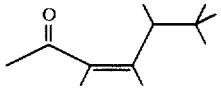

produced according to Example I.

Figure 2L:
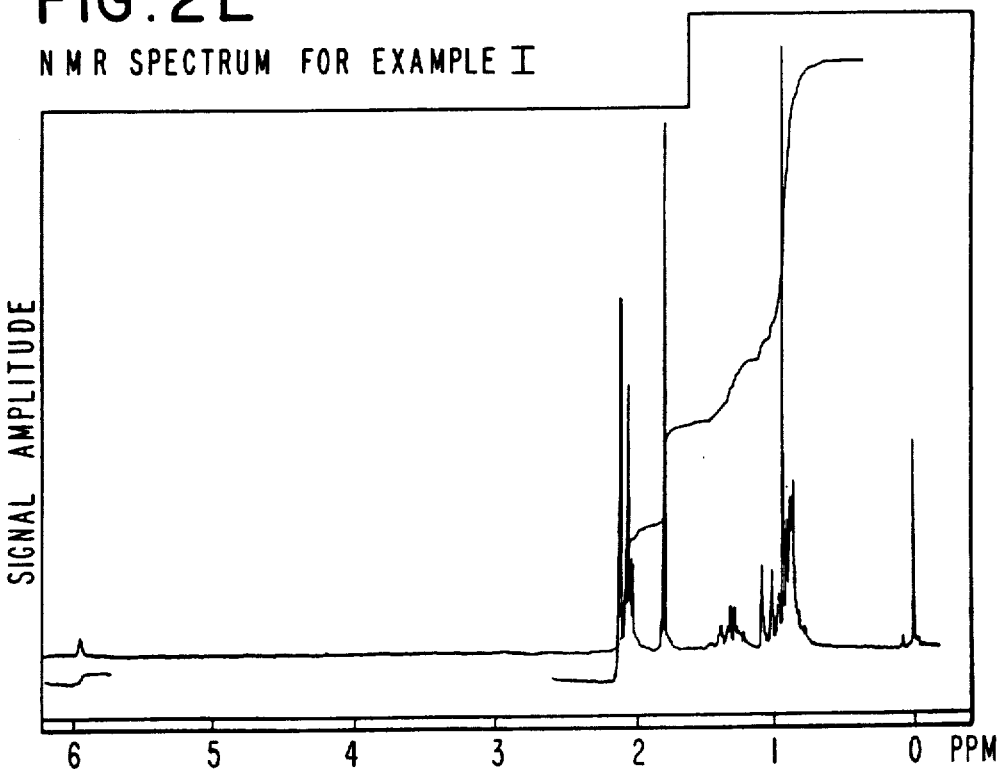

FIG. 2L represents the NMR spectrum for the compound containing the structure:

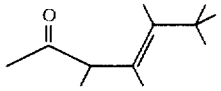

produced according to Example I.

Figure 3:
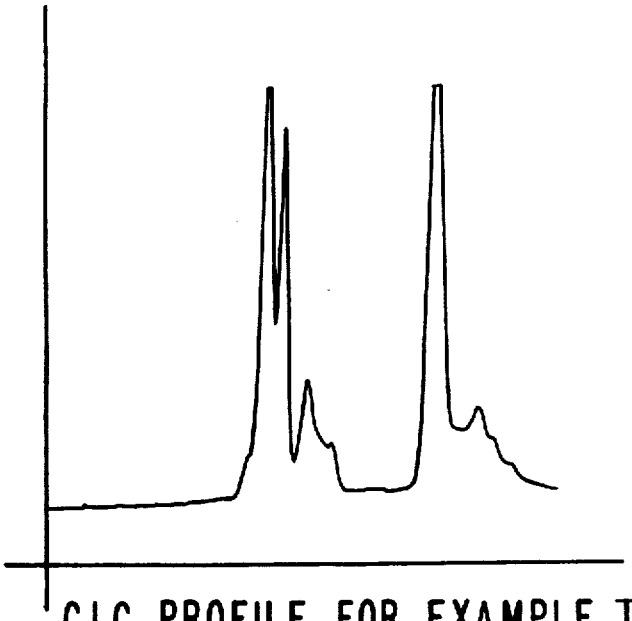

FIG. 3 is the GLC profile for the reaction product of Example II containing a mixture of compounds defined according to the structure:

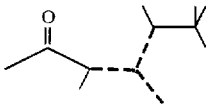

wherein in each molecule of the mixture, one of the dashed lines is a carbon-carbon double bond and the other of the dashed lines represent carbon-carbon single bond.

Figure 4:
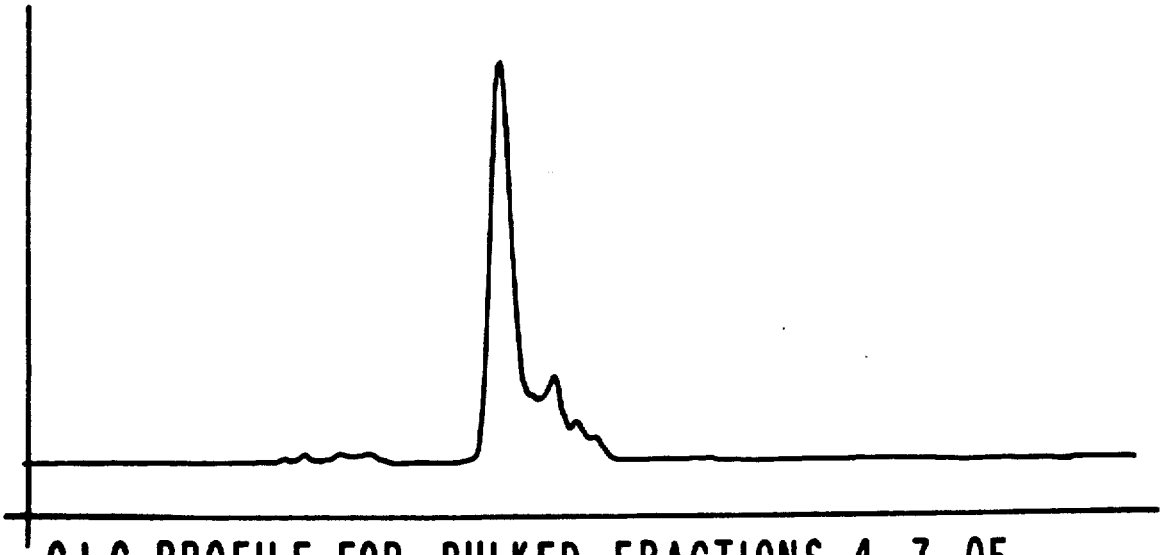

FIG. 4 is the GLC profile for bulked fractions 4–7 of the distillation product of reaction product of Example II containing a compound defined according to the structure:

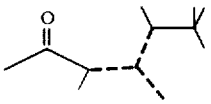

wherein in each molecule of the mixture, one of the dashed lines is a carbon-carbon double bond and the other of the dashed lines are carbon-carbon single bonds.

Figure 5:
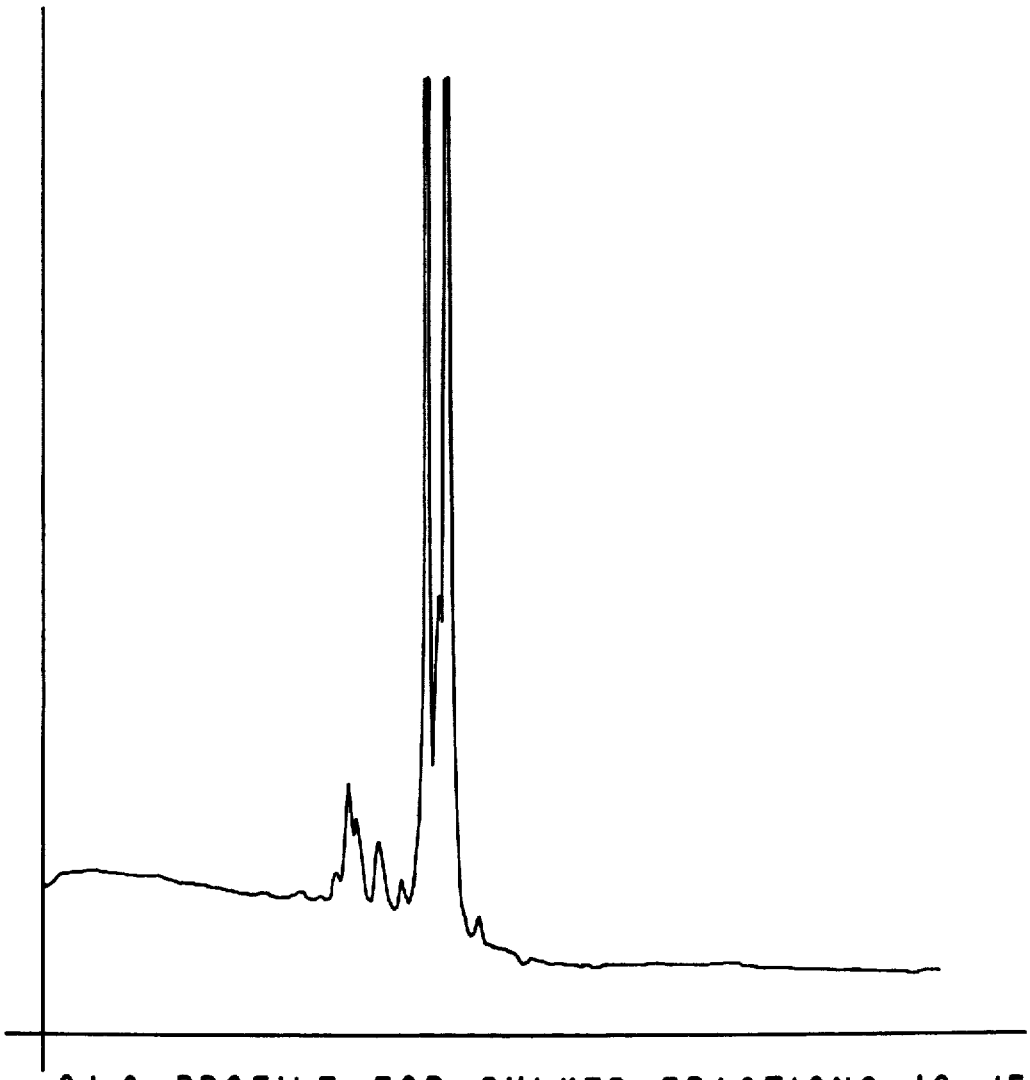

FIG. 5 is the GLC profile for bulked fractions 12–15 of the distillation product of the reaction product of Example III containing the compound having the structure:

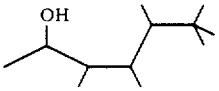

Figure 6:
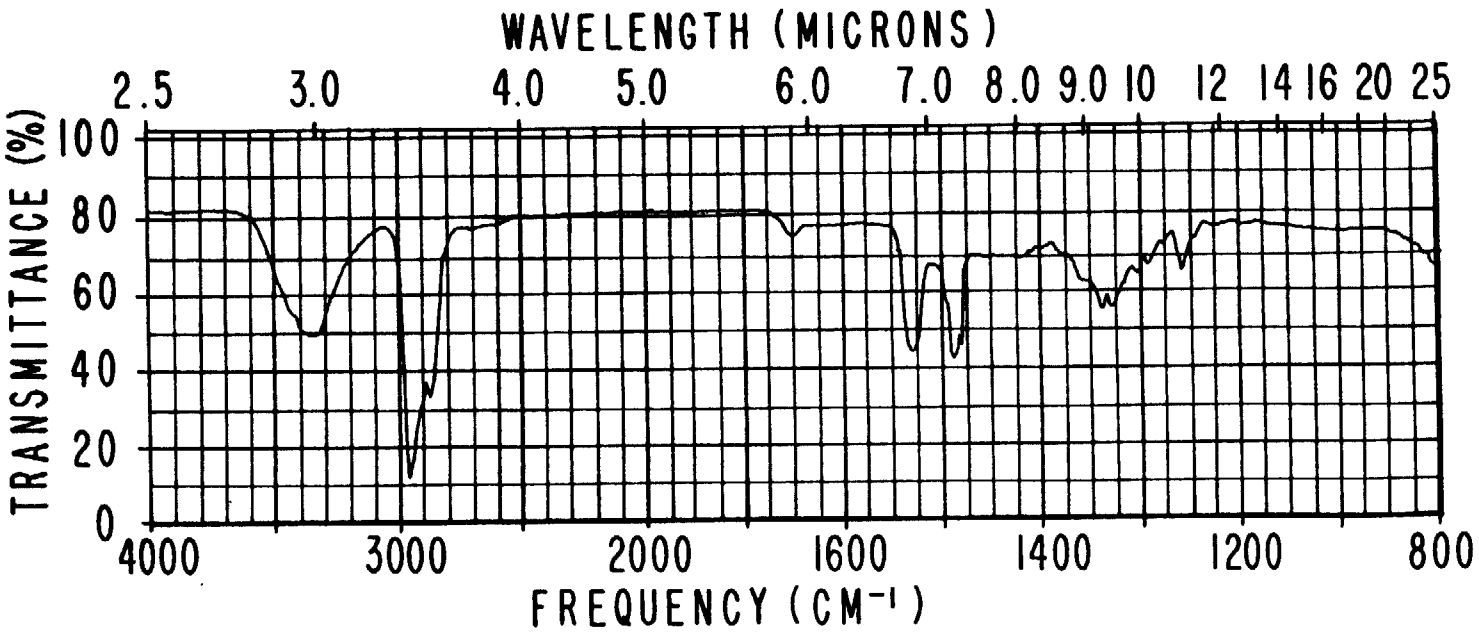

FIG. 6 is the infra-red spectrum for bulked fractions 12–15 of the distillation product of the reaction product of Example III containing the compound defined according to the structure:

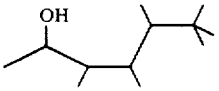

Figure 7:
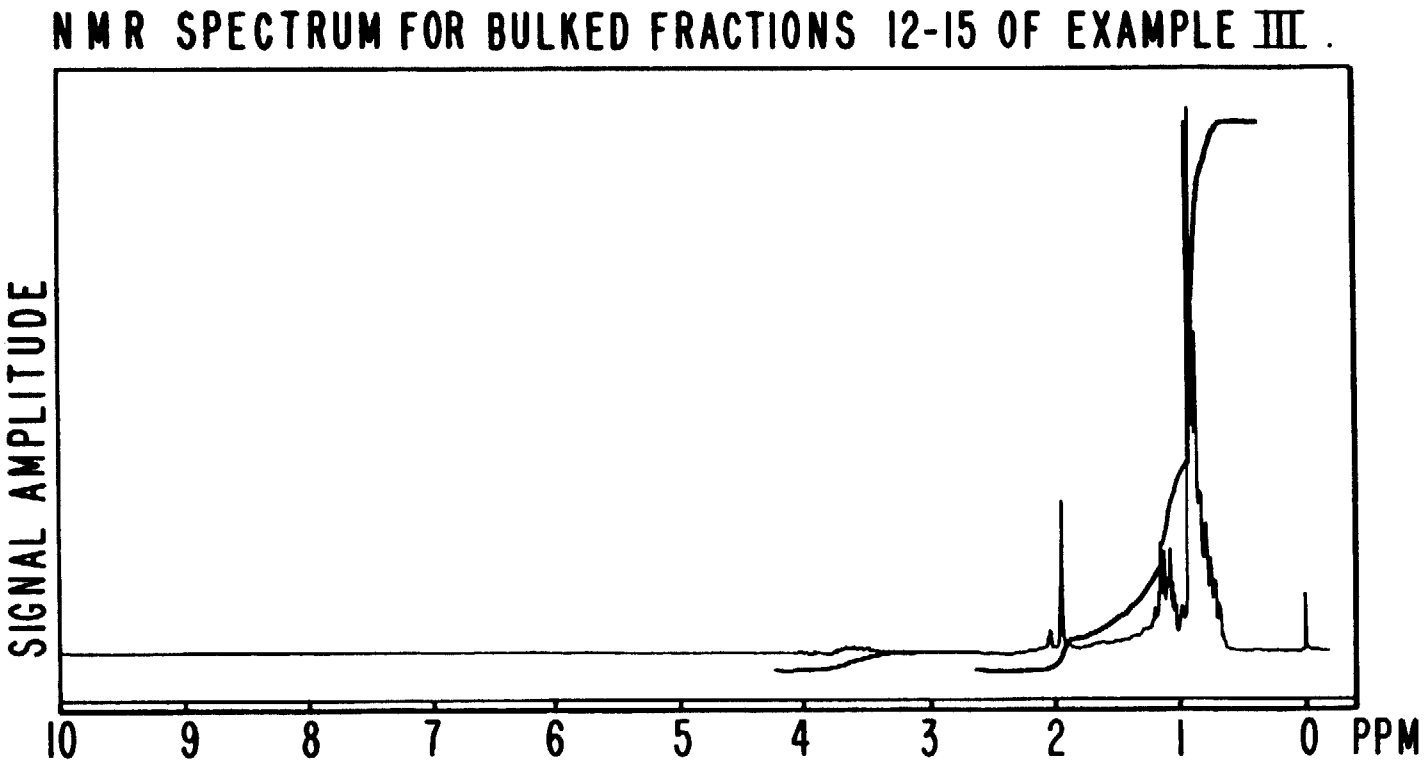

FIG. 7 is the NMR spectrum for bulked fractions 12–15 of the distillation product of the reaction product of Example III containing the compound having the structure:

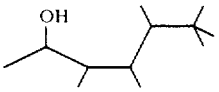

(Solvent: $CFCl_3$; Field strength: 100 MHz).

Figure 8:
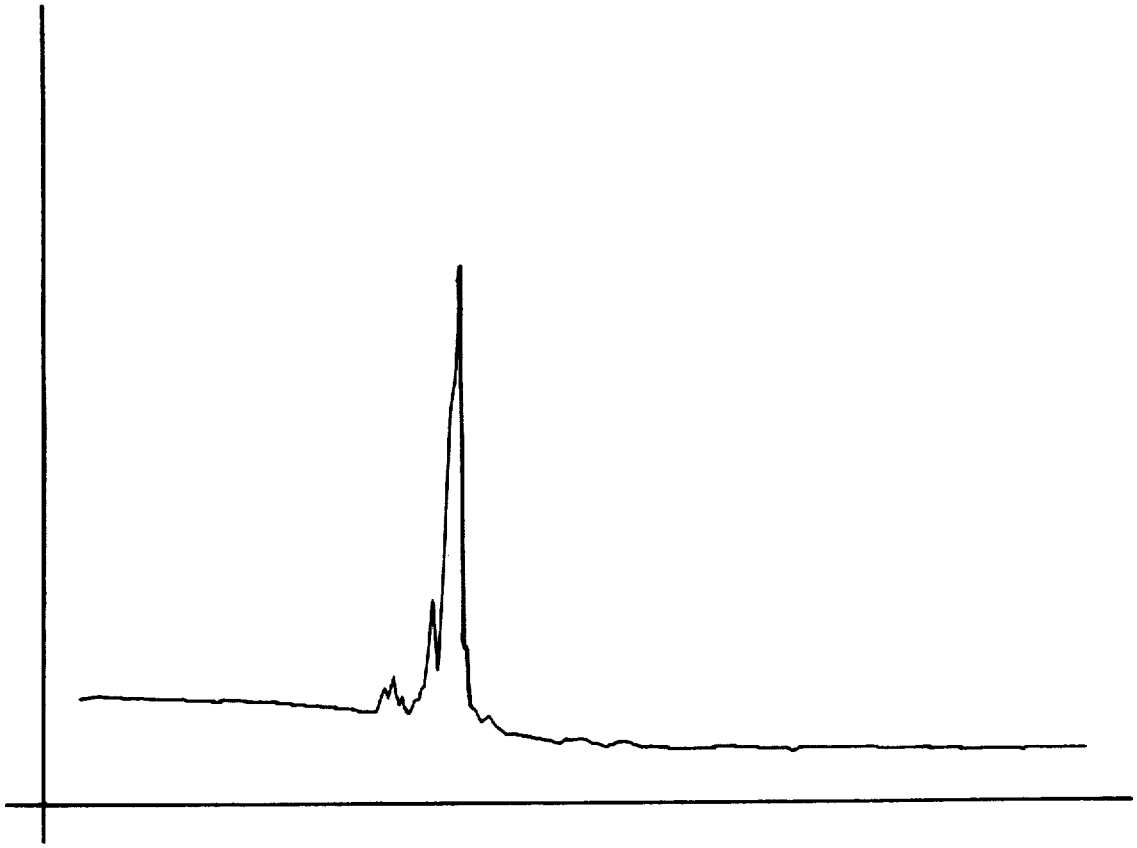

FIG. 8 is the GLC profile for fraction 8 of the distillation product of the reaction product of Example IV containing the compound having the structure:

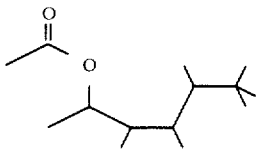

Figure 9:
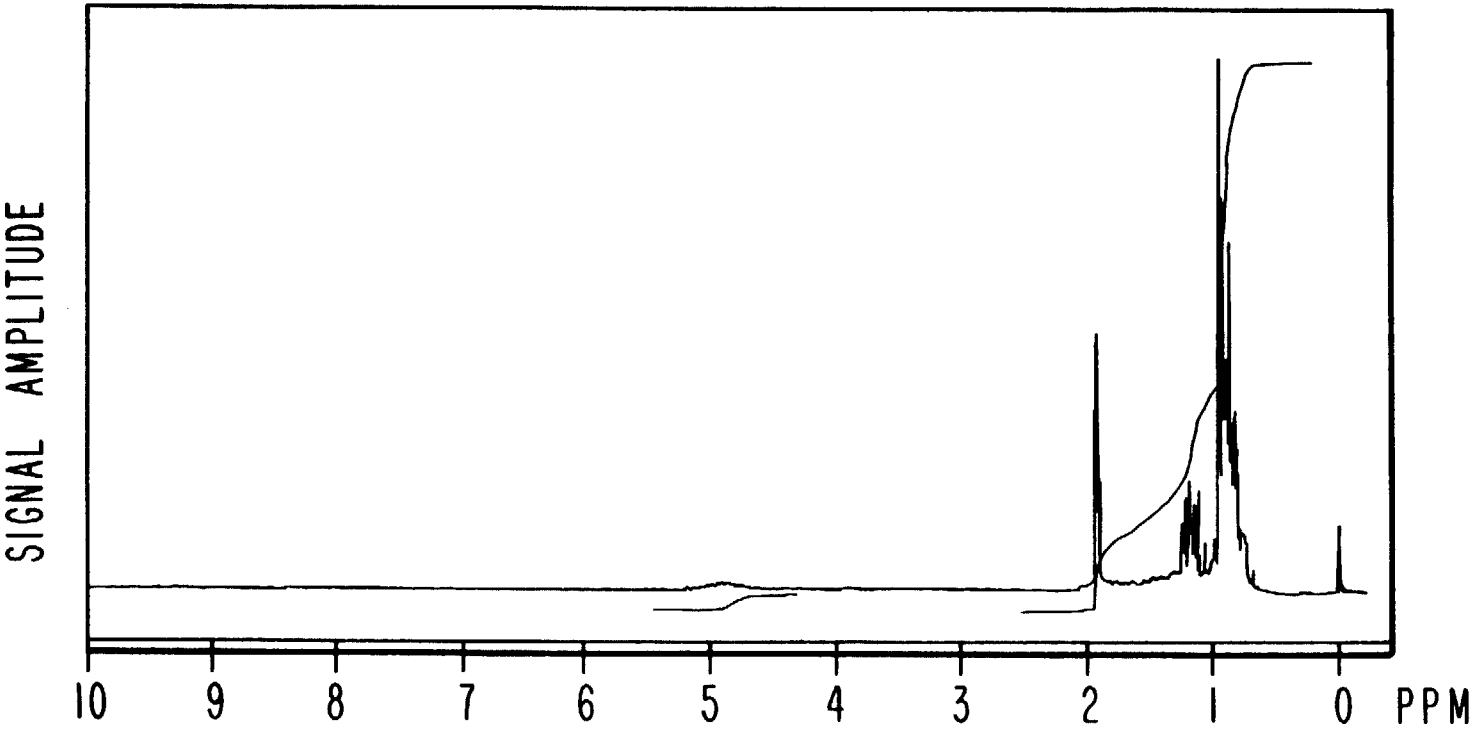

FIG. 9 is the NMR spectrum for fraction 8 of the distillation product of the reaction product of Example IV containing the compound having the structure:

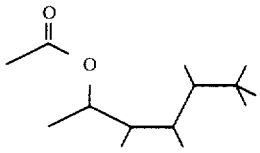

(Solvent: $CFCl_3$; Field strength: 100 MHz).

Figure 10:
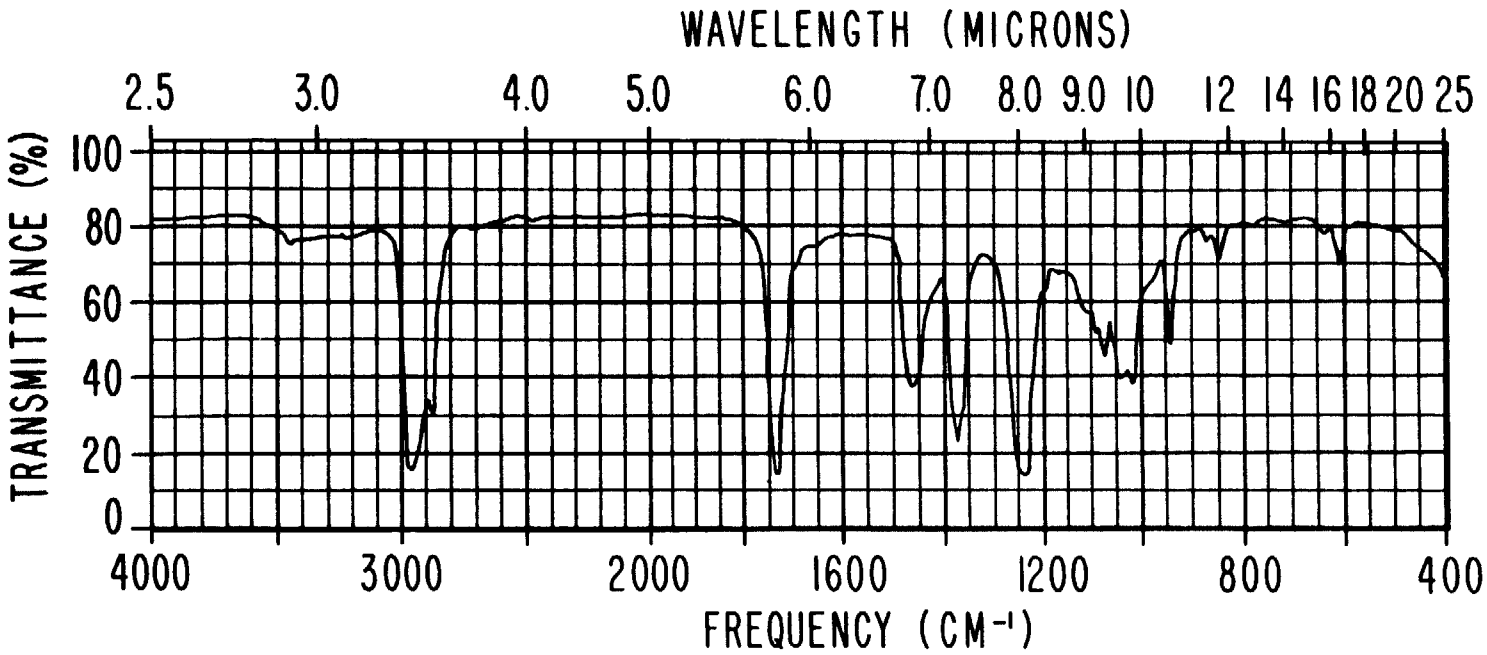

FIG. 10 is the infra-red spectrum for fraction 8 of the distillation product of the reaction product of Example IV containing the compound having the structure:

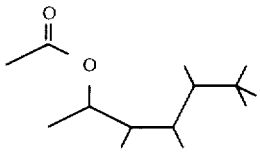

DISCLOSURES INCORPORATED BY REFERENCE HEREIN

The following applications for United States Letters Patent are incorporated by reference herein:

(a) U.S. Application for Letters Patent, Ser. No. 160,788 filed on June 19, 1980 now U.S. Pat. No. 4,287,084 issued on Sept. 1, 1981 (entitled: "Use of Mixture of Aliphatic $C_{10}$ Branched Olefins in Augmenting or Enhancing the Aroma of Perfumes and/or Perfumed Articles") setting forth the use of the compounds having the structures:

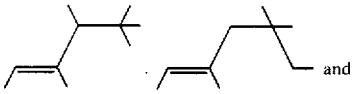

and

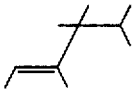

or generically the compounds defined according to the structure:

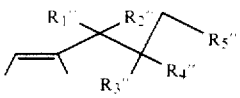

wherein $R_1''$, $R_2''$, $R_3''$, $R_4''$ and $R_5''$ represents hydrogen or methyl with three of $R_1''$, $R_2''$, $R_3''$, $R_4''$ and $R_5''$ representing methyl and the other two of $R_1''$, $R_2''$, $R_3''$, $R_4''$ and $R_5''$ representing hydrogen;

(b) Application for U.S. Letters Patent, Ser. No. 188,576 filed on Sept. 18, 1980 now U.S. Pat. No. 4,303,555 issued on Dec. 1, 1981, a continuation-in-part of Ser. No. 160,788 filed on June 19, 1980; and (c) Application for U.S. Letters Patent, Ser. No. 184,132 filed on Sept. 4, 1980 now U.S. Pat. No. 4,321,255 issued on Mar. 23, 1982 entitled "Branched Ketones, Organoleptic Uses Thereof and Process for Preparing Same" disclosing the reaction:

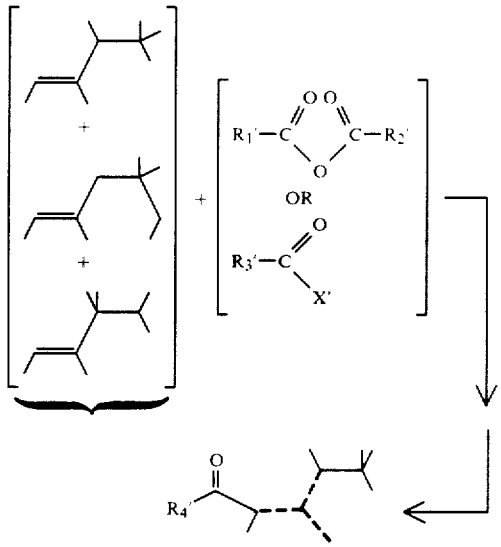

wherein $R_1'$, $R_2'$, and $R_3'$ represent $C_1$–$C_3$ lower alkyl and $R_4'$ is either of $R_1'$, $R_2'$ or $R_3'$ and wherein X' is chloro, or bromo, and the use of the resulting compounds for their organoleptic properties.

The instant application is directed to the use of the compounds defined according to the generic structure:

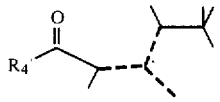

as starting materials wherein $R_4'$ is $C_1$–$C_3$ lower alkyl and wherein one of the dashed lines represents a carbon-carbon double bond and each of the other of the dashed lines represent carbon-carbon single bonds produced according to the process of Application for United States Letters Patent, Ser. No. 184,132 filed on Sept. 4, 1980 now U.S. Pat. No. 4,321,255 issued on Mar. 23, 1982 entitled "Branched Ketones, Organoleptic Uses Thereof and Process for Preparing Same."

The instant application is also directed to the use of the compounds defined according to the generic structure:

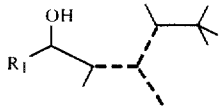

as starting materials wherein $R_1$ is $C_1$–$C_3$ lower alkyl and wherein one of the dashed lines represents a carbon-carbon double bond and each of the other of the dashed lines represent carbon-carbon single bonds produced according to the process of Application for United States Letters Patent, Ser. No. 252,334 filed on Apr. 9, 1981 entitled "Branched Chain Olefinic Alcohol Styles Esters and Ethers, Organoleptic Uses Thereof, Processes for Preparing Same and Intermediates Therefor".

THE INVENTION

It has now been determined that certain branched chain secondary alcohol esters are capable of imparting a variety of flavors and fragrances to various consumable materials. Briefly, our invention contemplates branched chain aliphatic saturated alcohol esters defined according to the generic structure:

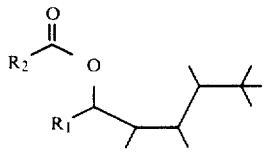

wherein $R_1$ represents $C_1$–$C_3$ alkyl and $R_2$ represents hydrogen or $C_1$–$C_3$ alkyl.

The branched chain saturated secondary alcohol esters of our invention are either usable in admixture with one another or alone, or the isomers are usable in admixture with one another in or admixture with the branched chain olefinic secondary alcohols of application for United States Letters Patent Ser. No. 252,334 filed on Apr. 9, 1981. The isomers of the individual compounds of our invention are stereoisomers, for example, two isomers of the idential compound defined according to the structure:

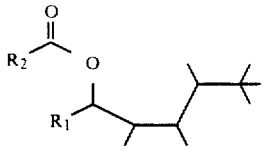

are as follows:

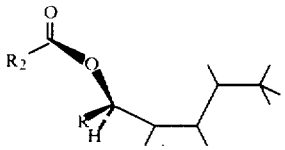

and

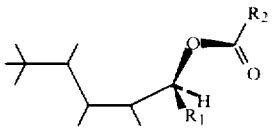

Other stereoisomers exist in view of the fact that the compounds of our invention having the structure:

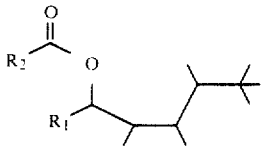

have four asymetric carbon atoms at the locations marked with an asterisk (*) as follows:

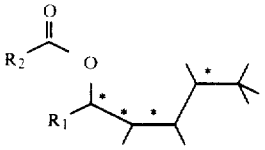

The esters of our invention may be produced by esterification of saturated alcohols having the structure:

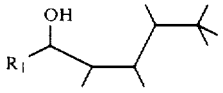

with an acyl anhydride having the structure:

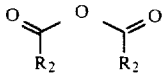

according to the reaction:

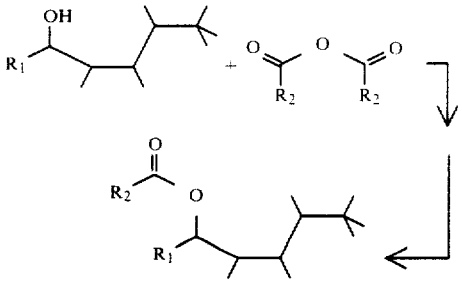

The saturated alcohols having the structure:

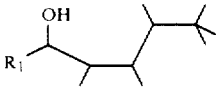

in turn, are produced by means of catalytic hydrogenation of a member of one of the genera of compounds defined according to the structure:

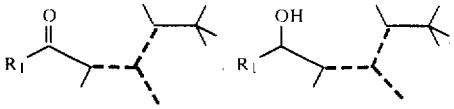

and/or

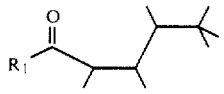

according to the reactions:

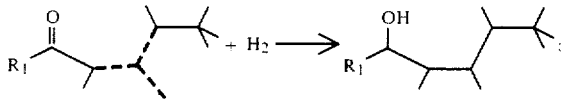

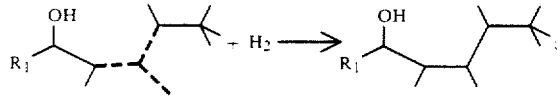

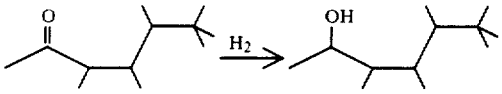

The branched chain olefinic secondary alcohols defined according to the structure:

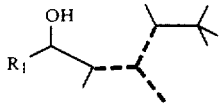

are, in turn, obtained by means of reaction of the ketones
having the structure:

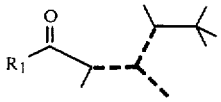

produced according to application for United States Letters Patent Ser. No. 184,132 filed on Sept. 4, 1980, now U.S. Pat. No. 4,321,255 issued on Mar. 10, 1982 entitled "BRANCHED KETONES, ORGANOLEPTIC USES THEREOF AND PROCESSES FOR PREPARING SAME" with a reducing agent such as:

(a) one or more alkali metal borohydrides, e.g. sodium borohydride, lithium borohydride and potassium borohydride;

(b) hydrogen, using a catalyst such as 5% palladium on carbon, 5% palladium on calcium carbonate or palladium on barium sulfate (e.g. "Lindlar Catalyst"); or (c) lithium aluminum hydride;

(d) aluminum alkoxides, such as aluminum isopropoxide and aluminum secondary propyl epoxide according to the reactions:

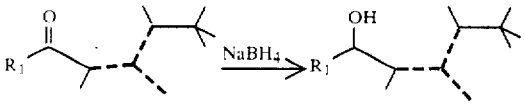

or

-continued

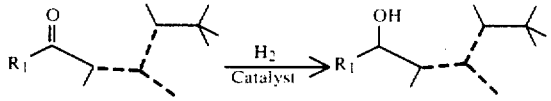

or, in general

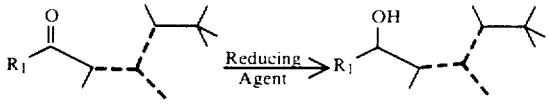

wherein $R_1$ represents $C_1$-$C_3$ alkyl and $R_2$ represents hydrogen or $C_1$-$C_3$ alkyl; and wherein the compounds having the dashed lines either represent pure compounds or mixtures wherein one of the dashed lines represents a carbon-carbon double bond (in each of the molecules of the mixture or in each of the compounds) and the other of the dashed lines represent carbon-carbon single bonds.

The compounds defined according to the structure:

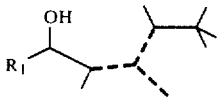

are produced according to application for United States Letters Patent, Ser. No. 252,334 filed on Apr. 9, 1981 the disclosure of which is incorporated by reference herein. The instant application is a continuation-in-part of application for U.S. Letters Patent, Ser. No. 252,334 filed on Apr. 9, 1981.

When carrying out the reaction for reacting the ketone having the structure:

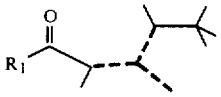

with hydrogen in the presence of a Raney nickel catalyst or a Rhodium catalyst, it is preferably carried out in the absence of a solvent. Thus, a solvent can be used and the workable solvents are ones which "solvate" the carbonal moiety in order to enable the reaction to proceed at a reasonable rate and these are isopropyl alcohol, n-propanol, n-butanol, isobutyl alcohol and t-butyl alcohol.

The temperature of reaction is necessarily a function of:

(i) the yield desired;

(ii) the time of reaction;

(iii) the nature of the solvent used, if any;

(iv) the pressure of the vapor over the reaction mass;

(v) the concentration of the reactant having the structure:

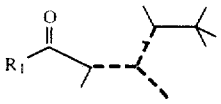

in the solvent:

(vi) the desired rate of reaction; and (vii) the mole ratio of reactant having the structure:

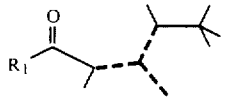

hydrogenation catalyst:total number of moles of hydrogen gas used.

It is preferred to carry out the reaction:

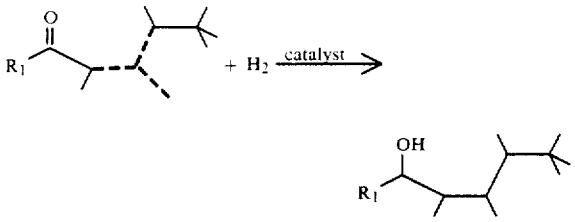

at a temperature in the range of 100°-200° C. and at a pressure in the range of 400-1400 psig.

More stringent conditions, however, are required to carry the reaction:

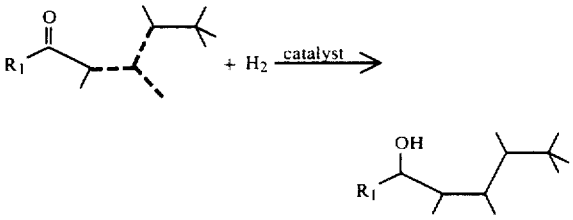

to completion when using a Raney nickel catalyst than when using a Rhodium catalyst. Accordingly, the most preferred catalyst is a supported Rhodium catalyst on carbon.

When it is desired to carry out the hydrogenation reaction on the unsaturated alcohol according to the reaction:

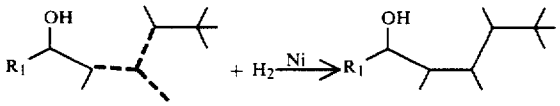

the similar set of conditions as set forth above is required. Thus, the reaction may be carried out using Raney nickel or Rhodium on carbon at a temperature in the range of from about 400° up to 200° C. and a pressure in the range of from about 400 up to 1400 psig.

The compounds having the structure:

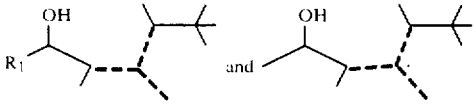

wherein R is $C_1$-$C_3$ alkyl and one of the dashed lines is a carbon-carbon double bond and each of the other of the dashed lines represent carbon-carbon single bonds may be prepared according to the conditions set forth in application for U.S. Letters Patent Ser. No. 252,334 filed on Apr. 9, 1981.

With respect to the esterification reaction:

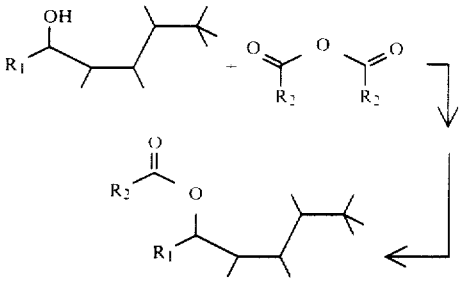

it is preferred that the mole ratio of saturated alcohol:acyl anhydride be between from about 1:0.5 up to about 1:1, since 0.5 moles of acyl anhydride reacts with 1 mole of saturated alcohol having the structure, for example,

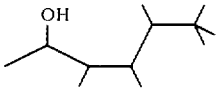

It is preferred that the temperature of reaction for this esterification be between 80° C. and about 140° C. At atmospheric pressure, it is preferred to carry out the reaction at about 100°-110° C. At the end of the reaction, the reaction mass is "quenched" with water and extracted with an appropriate solvent such as toluene. The extract is stripped of solvent and distilled in a fractional distillation column to yield the desired ester defined according to the structure:

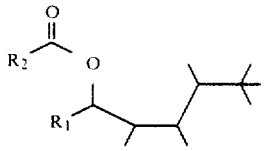

The individual branched chain secondary alcohol esters of our invention can be obtained in pure form or in substantially pure form by a conventional purification technique. Thus, the products can be purified by distillation, extraction, crystallization, preparative chromatographic techniques (including high pressure liquid chromatography) and the like. It has been found desirable to purify the branched chain saturated secondary alcohol esters of our invention by fractional distillation under vacuum.

It will be appreciated from the present disclosure that the branched chain saturated secondary alcohol esters and mixtures thereof according to the present invention can be used to alter, vary, fortify, modify, enhance or otherwise improve the flavor and aroma of a wide variety of materials which are ingested, consumed or otherwise organoleptically sensed, particularly including perfume compositions, perfumed articles and smoking tobacco compositions and smoking tobacco articles.

The term "alter" in its various forms will be understood herein to mean the supplying or imparting of a flavor character or note or aroma character to an otherwise bland, relatively aromaless or tasteless substance.

or augmenting an existing flavor or aroma characteristic where the natural flavor or aroma is deficient in some regard or supplementing the existing flavor or aroma impression to modify the organoleptic character.

The term "enhance" is intended herein to mean the intensification of a particular aroma or taste nuance (particularly in perfumes, perfumed articles or smoking tobaccos) without the changing of the quality of said nuance and without adding an additional aroma or taste nuance to the consumable material, the organoleptic properties of which are enhanced.

The term "tobacco" will be understood herein to mean a natural product such as, for example, burley, Turkish tobacco, Maryland tobacco, flue-cured tobacco and the like including tobacco-like or tobacco-based products such as reconstituted or homogenized leaf and the like, as well as tobacco substitutes intended to replace natural tobacco, such as lettuce and cabbage leaves and the like. The tobaccos and tobacco products in which the branched chain saturated secondary alcohol esters of our invention are useful include those designed or used for smoking such as in cigarette, cigar and pipe tobacco, as well as products such as snuff, chewing tobacco and the like.

The branched chain saturated secondary alcohol esters of our invention can be used to contribute warm, sweet, woody, ambery, floral, piney, fruity and musky aromas with ionone-like undertones. As olfactory agents, the branched chain saturated secondary alcohol esters of this invention can be formulated into or used as components of a "perfume composition".

The term "perfume composition" is used herein to mean a mixture of organic compounds, including, for example, alcohols, aldehydes, ketones, nitriles, esters (other than the esters of this invention) and frequently hydrocarbons which are admixed so that the combined odors of the individual components produce a pleasant or desired fragrance. Such perfume compositions usually contain: (a) the main note of the "bouquet" or foundation-stone of the composition; (b) modifiers which round off and accompany the main note; (c) fixatives which include odorous substances which lend a particular note to the perfume throughout all stages of evaporation, and substances which retard evaporation; and (d) topnotes which are usually low-boiling fresh-smelling materials.

In perfume compositions, the individual component will contribute its particular olfactory characteristics but the overall effect of the perfume composition will be the sum of the effect of each ingredient. Thus, the individual compounds of this invention, or mixtures thereof, can be used to alter the aroma characteristics of a perfume composition, for example, by highlighting or moderating the olfactory reaction contributed by another ingredient in the composition.

The amount of branched chain saturated secondary alcohol esters of this invention which will be effective in perfume compositions depends on many factors, including the other ingredients, their amounts and the effects which are desired. It has been found that perfume compositions containing as little as 0.05% and as much as 5% of the branched chain saturated secondary alcohol esters of this invention can be used to impart, augment or enhance sweet, warm, woody, ambery, floral, piney, fruity and musky aroma profiles to soaps, cosmetics, solid or liquid anoinic, cationic, nonionic and zwitterionic detergents, fragranced polymers and other products. The amount employed can range up to 50% of the fragrance and can be as low as 1% of the original fragrance and will depend on considerations of cost, nature of the end product, the effect desired in the finished product and the particular fragrance sought.

The branched chain saturated secondary alcohol esters of this invention can be used alone or in a perfume composition as an olfactory component in detergents, and soaps, space odorants and deodorants, perfumes, colognes, toilet waters, bath salts, hair preparations such as lacquers, brilliantines, pomades, and shampoos, cosmetic preparations such as creams, deodorants, hand lotions and sun screens, powders such as talcs, dusting powders, face powder, and the like. When used as an olfactory component of a perfumed article, as little as 0.05% of one or more of the branched chain saturated secondary alcohol ester(s) will suffice to impart sweet, warm, woody, ambery, floral, piney, fruity and musky aroma nuances with ionone-like undertones. Generally no more than 5.0% is required.

In addition, the perfume composition can contain a vehicle or carrier for the branched chain saturated secondary alcohol esters taken alone or taken together with other ingredients. The vehicle can be a liquid such as an alcohol such as ethanol, a glycol such as propylene glycol, or the like. The carrier can be an absorbent solid such as a gum or a microporous polymer or components for encapsulating the composition such as by means of coacervation.

An additional aspect of our invention provides an organoleptically improved smoking tobacco product and additives therefor, as well as methods of making the same which overcome specific problems heretofore encountered in which specific desired oriental and woody flavor and aroma characteristics are created or enhanced and may be readily controlled and maintained at the desired uniform level regardless of variations in the tobacco components of the blend.

This invention further provides improved tobacco additives and methods whereby various desirable woody and oriental flavor and aroma characteristics may be imparted to smoking tobacco products and may be readily varied and controlled to produce the desired uniform flavoring characteristics prior to and on smoking in the mainstream and in the sidestream.

In carrying out this aspect of our invention, we add to smoking tobacco materials or a suitable substitute therefor (e.g. dried lettuce leaves) an aroma and flavor additive containing as an active ingredient at least one of the secondary alcohol esters of our invention.

In addition to the one or more secondary alcohol esters of our invention, other flavoring and aroma additives may be added to the smoking tobacco material or substitute therefor either separately or in admixture with the secondary alcohol esters as follows:

I. Synthetic Materials:
- Beta-ethyl-cinnamaldehyde;
- Eugenol;
- Dipentene;
- Alpha-damascone;
- Beta-damascone;
- 1-[3-(methylthio)butyryl]2,3,3-trimethyl-cyclohexene;
- Beta-Damascenone;
- Maltol;
- Ethyl maltol;
- Delta undecalactone;
- Delta decalactone;
- Benzaldehyde;

Amyl acetate;
Ethyl butyrate;
Ethyl acetate;
2-Hexenol-1;
2-Methyl-isopropyl-1,3-nonadiene-8-one;
2,6-Dimethyl-2,6-undecadiene-10-one;
2-Methyl-5-isopropyl acetophenone;
2-Hydroxy-2,5,5,8a-tetramethyl-1-(2-hydroxyethyl)-decahydronaphthalene;
Dodecahydro-3a,6,6,9a-tetramethyl naphtho-(2-1-b)-furan;
4-Hydroxy hexanoic acid, gamma lactone;
Polyisoprenoid hydrocarbons defined in Example V of U.S. Pat. No. 3,589,372 issued on June 29, 1971.

II. Natural oils:
Celery seed oil;
Coffee extract;
Bergamot oil;
Cocoa extract;
Nutmeg oil; and
Origanum oil.

An aroma and flavoring concentrate containing one or more of the secondary alcohol esters of our invention and, if desired, one or more of the above indicated flavoring additives may be added to the smoking tobacco material, to the filter or to the leaf or paper wrapper. The smoking tobacco material may be shredded, cured, cased and blended tobacco material or reconstituted tobacco material or tobacco substitutes (e.g. dried lettuce leaves) or mixtures thereof. The proportions of flavoring additives may be varied in accordance with taste but insofar as the augmentation, or the enhancement or the imparting of the woody and oriental notes are concerned, we have found that satisfactory results are obtained if the proportion by weight of the sum total of secondary alcohol esters of our invention is between 250 ppm and 1,500 ppm (0.025%–1.5%) of the active ingredients to the smoking tobacco material. We have further found that satisfactory results are obtained if the proportion by weight of the sum total of secondary alcohol esters used to flavoring material is between 2,500 and 10,000 ppm (0.25%–1.5%).

Any convenient method for incorporating the secondary alcohol esters in the tobacco product may be employed. Thus, the secondary alcohol esters taken alone or along with other flavoring additives may be dissolved in a suitable solvent such as ethanol, n-pentane, diethyl ether and/or other volatile organic solvents and the resulting solution may either be sprayed on the cured, cased and blended tobacco material or the tobacco material may be dipped into such solution. Under certain circumstances, a solution of one or more secondary alcohol esters of this invention taken alone or further together with other flavoring additives as set forth above may be applied by means of a suitable applicator such as a brush or roller on the paper or leaf wrapper for the smoking product, or it may be applied to the filter by either spraying or dipping or coating.

Furthermore, it will be apparent that only a portion of the tobacco or substitute therefor need be treated and the thus treated tobacco may be blended with other tobaccos before the ultimate tobacco product is formed. In such cases, the tobacco treated may have one or more of the secondary alcohol esters of this invention in excess of the amounts of concentrations above indicated so that when blended with other tobaccos, the final product will have the percentage within the indicated range.

In accordance with one specific example of our invention, an aged, cured and shredded domestic burley tobacco is sprayed with a 20% ethyl alcohol solution which is a mixture of stereoisomers defined according to the structure:

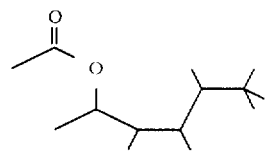

in an amount to provide a tobacco composition containing 800 ppm by weight of the secondary alcohol ester on a dry basis. Thereafter, the ethyl alcohol is removed by evaporation and the tobacco is manufactured into cigarettes by the usual techniques. The cigarette when treated as indicated, has a desired and pleasing aroma which is detectable in the main stream and the side stream when the cigarette is smoked. The aroma is described as being sweet, oriental-like, woody and Turkish tobacco-like.

While our invention is particularly useful in the manufacture of smoking tobacco, such as cigarette tobacco, cigar tobacco and pipe tobacco, other tobacco products formed from sheeted tobacco dust or fines may also be used. Likewise, the secondary alcohol esters of our invention can be incorporated with materials such as filter tip materials, seam paste, packaging materials and the like which are used along with tobacco to form a product adapted for smoking. Furthermore, the secondary alcohols of this invention can be added to certain tobacco substitutes of natural or synthetic origin (e.g. dried lettuce leaves) and, accordingly, by the term "tobacco" as used throughout this specification is meant any composition intended for human consumption by smoking or otherwise, whether composed of tobacco plant parts or substitute materials or both.

The following Examples A-III are given to illustrate techniques for producing the precursors for the compounds defined according to the structure:

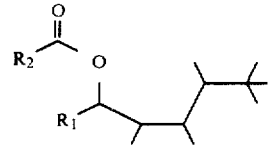

wherein $R_1$ is $C_1$–$C_3$ alkyl and $R_2$ is hydrogen or $C_1$–$C_3$ alkyl. The following Example IV is given to illustrate a process for producing compounds defined according to the structure:

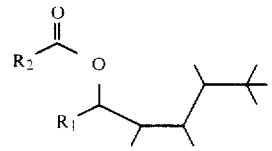

The examples following Example IV, that is, Examples V and onward are given to illustrate embodiments of our invention as it is presently preferred to practice it insofar as utilizing the compounds having the structure:

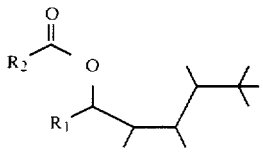

for their organoleptic properties. It will be understood that these examples are illustrative and the invention is not to be considered restricted thereto except as indicated in the appended claims.

EXAMPLE A

PREPARATION OF DI-ISOAMYLENE DERIVATIVES

Reaction:

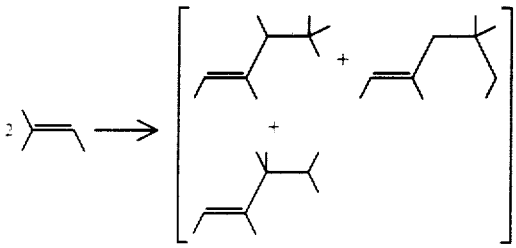

(wherein in each of the molecules indicated, one of the dashed lines is a carbon-carbon double bond and the other of the dashed lines are carbon-carbon single bonds).

Di-isoamylene is prepared according to one of the procedures set forth in the following references:

i—Murphy & Lane, Ind. Eng. Chem., Prod. Res. Dev., Vol. 14, No. 3, 1975 p. 167 (Title: Oligomerization of 2-Methyl-2-Butene in Sulfuric and Sulfuric-Phosphoric Acid Mixtures).

ii—Whitmore & Mosher, Vol. 68, J. Am. Chem. Soc., February, 1946, p. 281 (Title: The Depolymerization of 3,4,5,5-Tetramethyl-2-hexene and 3,5,5-Trimethyl-2-heptene in Relation to the Dimerization of Isoamylenes)

The resulting material was distilled in a fractionation column in order to separate the di-isoamylene from the higher molecular weight polymers, which are formed during the reaction as by-products.

FIG. AA represents the GLC profile for the reaction product of Example A using a 70% sulfuric acid catalyst at 35° C.

FIG. AB represents the GLC profile for the reaction product of Example A using an Amberlyst ®15 acidic ion exchange resin catalyst at a temperature of 150° C.

FIG. AC represents the GLC profile for the reaction product of Example A, using an Amberlyst ®15 catalyst at 100° C.

FIG. AD represents the GLC profile for the reaction product of Example A, using a sulfuric acid catalyst and an alpha-methylstyrene diluent at 35° C. according to the conditions of United Kingdom Patent Specification 796,130 (crude reaction product).

FIG. AE represents the GLC profile for the reaction product of Example I, using a sulfuric acid catalyst, at 35° C. and an alpha-methylstyrene diluent according to the conditions of United Kingdom Patent Specification 796,130 (distilled reaction product having a boiling range of 36°-38° C. at 4-5 mm Hg pressure).

FIG. BA represents the NMR spectrum for Peak 1 of the GLC profile of FIG. AE.

FIG. BB represents the infra-red spectrum for Peak 1 of the GLC profile of FIG. AE.

FIG. CA represents the NMR spectrum for Peak 2 of the GLC profile of FIG. AE.

FIG. CB represents the infra-red spectrum for Peak 2 of the GLC profile of FIG. AE.

FIG. D represents the NMR spectrum for Peak 2 of the GLC profile of FIG. AB.

EXAMPLE I

PREPARATION OF ACETYL DERIVATIVE OF DIISOAMYLENE

Reaction:

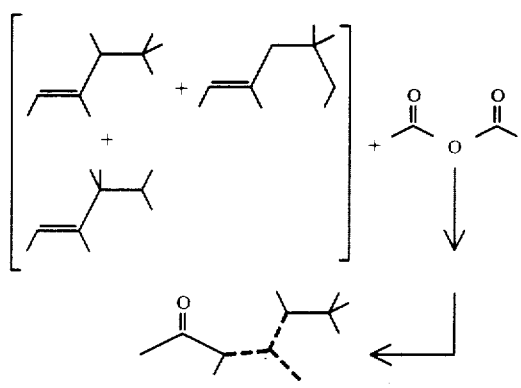

wherein in each of the structures containing dashed lines, these structures represent mixtures of molecules wherein in each of the molecules, one of the dashed lines represents a carbon-carbon double bond and each of the other of the dashed lines respresent carbon-carbon single bonds.

Into a 2-liter reaction flask equipped with stirrer, thermometer, reflex condenser and heating mantle, is placed 1000 g of acetic anhydride and 80 g of boron trifluoride diethyl etherate. The resulting mixture is heated to 80° C. and, over a period of 40 minutes, 690 g of diisoamylene prepared according to the illustration in Example A, supra is added. The reaction mass is maintained at 82°-85° C. for a period of 5.5 hours, whereupon it is cooled to room temperature. The reaction mass is then added to one liter of water and the resulting mixture is stirred thereby yielding two phases; an organic phase and an aqueous phase. The organic phase is separated from the aqueous phase and neutralized with two liters of 12.5% sodium hydroxide followed by one liter of saturated sodium chloride solution. The resulting organic phase is then dried over anhydrous sodium sulfate and distilled in a one plate distillation column, yielding the following fractions:

| Fraction No. | Vapor Temp. (°C.) | Liquid Temp. (°C.) | mm/Hg Pressure | Weight of Fraction (g.) |
|---|---|---|---|---|
| 1 | 33/68 | 62/77 | 8/8 | 161 |
| 2 | 69 | 79 | 4 | 100 |
| 3 | 72 | 86 | 3.0 | 191 |
| 4 | 88 | 134 | 3.0 | 189 |

The resulting material is then distilled on a multi-plate fractionation column, yielding the following fractions at the following reflux ratios:

| Fraction No. | Vapor Temp. (°C.) | Liquid Temp. (°C.) | mm/Hg Pressure | Reflux Ratio R/D | Weight of Fraction (g.) |
|---|---|---|---|---|---|
| 1 | 30/65 | 62/83 | 5/5 | 9:1 | 30.8 |
| 2 | 68 | 84 | 5 | 9:1 | 52.8 |
| 3 | 68 | 85 | 5 | 9:1 | 34 |
| 4 | 69 | 87 | 5 | 9:1 | 43 |
| 5 | 69 | 87 | 5 | 9:1 | 34 |
| 6 | 71 | 88 | 4 | 4:1 | 41 |
| 7 | 70 | 88 | 5 | 4:1 | 36.5 |
| 8 | 71 | 91 | 5 | 4:1 | 42 |
| 9 | 73 | 95 | 3 | 4:1 | 42.5 |
| 10 | 80 | 106 | 3 | 4:1 | 39 |
| 11 | 80 | 142 | 3 | 4:1 | 50.8 |
| 12 | 80 | 220 | 3 | 4:1 | 24 |

Fractions 2–9 are bulked and GLC, NMR, IR and mass spectral analyses yield the information that the resulting material is a mixture of cis and trans isomers having a generic structure:

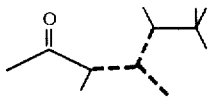

wherein in each of the molecules, one of the dashed lines is a carbon-carbon double bond and the other of the dashed lines is a carbon-carbon single bond and, primarily, this mixture contains the molecular species (cis and trans isomers) as follows:

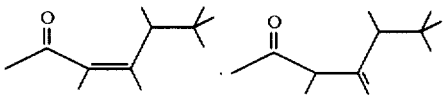

and

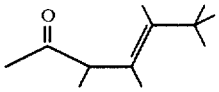

FIG. 1 sets forth the GLC profile for the reaction product of Example I, containing compounds defined according to the structure:

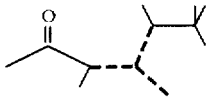

wherein in each molecule of the mixture, one of the dashed lines is a carbon-carbon double bond and the other of the dashed lines are carbon-carbon single bonds.

FIG. 2A represents the infra-red spectrum for Peak 3 of the GLC profile of FIG. 1.

FIG. 2B represents the infra-red spectrum of Peak 4 of the GLC profile of FIG. 1.

FIG. 2C represents the infra-red spectrum for Peak 5 of the GLC profile of FIG. 1.

FIG. 2D represents the infra-red spectrum for Peak 6 of the GLC profile of FIG. 1.

FIG. 2E represents the infra-red spectrum for Peak 7 of the GLC profile of FIG. 1.

FIG. 2F represents the infra-red spectrum for Peak 8 of the GLC profile of FIG. 1.

FIG. 2G represents the infra-red spectrum for Peak 9 of the GLC profile of FIG. 1.

FIG. 2H represents the infra-red spectrum for Peak 10 of the GLC profile of FIG. 1.

FIG. 2J represents the NMR spectrum for a mixture of compounds having the structures:

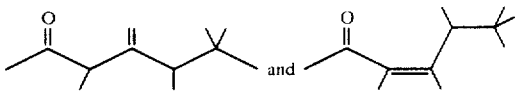

produced according to Example I.

FIG. 2K represents the NMR spectrum for the compound having the structure:

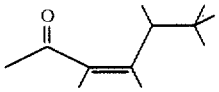

produced according to Example I.

FIG. 2L represents the NMR spectrum for the compound containing the structure:

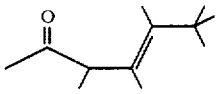

produced according to Example I.

EXAMPLE II

PREPARATION OF ISOBUTYRYL DERIVATIVE OF DIISOAMYLENE

Reaction:

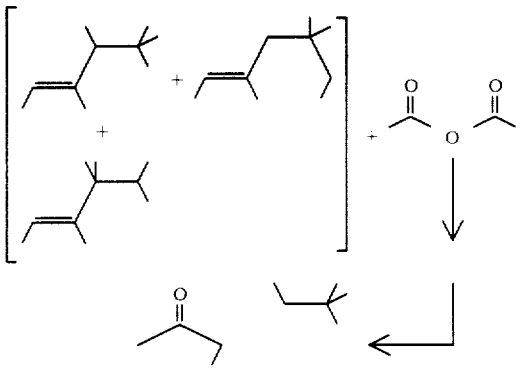

(wherein in each of the structures containing the dashed lines, these structures represent mixtures of molecules wherein in each of the molecules, one of the dashed lines represents a carbon-carbon double bond and each of the other of the dashed lines represent carbon-carbon single bonds).

Into a 12-liter reaction flask, equipped with nitrogen blanket apparatus, gas addition set up and dry tap and sodium hydroxide scrubber on reaction outlet is placed 2358 g (23.1 moles) of acetic anhydride and 4620 g (33 moles) of diisoamylene prepared according to Example AE. The resulting mixture is heated to 55° C. while maintaining the reaction mass at 54°-55° C. over a period of 1 hour, 169 g (2.5 moles) of boron trifluoride gas is added to the reaction mass with stirring.

The reaction mass is then heated for a period of 2 hours with stirring at 55%° C.

The reaction mass is then transferred to a separatory funnel and in the separatory funnel the reaction mass is washed with 4 liters of 12.5% aqueous sodium hydroxide. The aqueous layer is separated from the organic layer and the organic layer is washed with three 6 liter volumes of water until the pH is about 7.

The reaction mass is then distilled on a two inch splash column yielding the following fractions:

| Fraction No. | Vapor Temp. (°C.) | Liquid Temp. (°C.) | Vacuum mm Hg Pressure |
|---|---|---|---|
| 1 | 28/47 | /56 | 50/8 |
| 2 | 63 | 80 | 4.0 |
| 3 | 76 | 87 | 4.0 |
| 4 | 87 | 96 | 3.5 |
| 5 | 87 | 100 | 3.5 |
| 6 | 90 | 113 | 3.5 |
| 7 | — | — | 3.5 |

Fraction 4-7 are then bulked for subsequent reaction in Example III.

FIG. 3 is the GLC profile for the current reaction product (Conditions: 6'×¼ inch 12% S.F. 96, column programmed at 100°-220° C. at 8° C. per minute).

FIG. 4 is the GLC profile for bulked fractions 4-7 of the foregoing distillation (Conditions: 6'×¼ inch 12% S.F. 96, column programmed at 100°-220° C. at 8° C. per minute).

EXAMPLE III

PREPARATION OF 3,4,5,6,6-PENTAMETHYL-HEXANOL-2

Reaction:

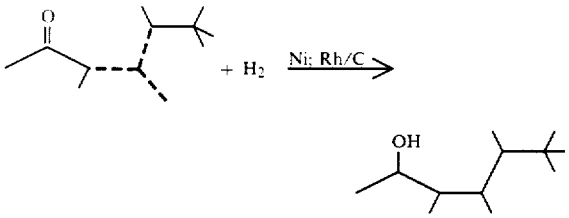

Into a 1 liter autoclave equipped for 2000 psig pressure is placed 498 g of the reaction product of Example II (bulked fractions 4-7) and 16 g of Raney nickel. The autoclave is sealed and the products are hydrogenated at a temperature in the range of 460-480 psig and a temperature in the range of 130°-150° C. for a period of 15 hours. The autoclave is then cooled down, depressurized and opened and the Raney nickel catalyst is filtered and replaced with 2.5 g of 5% Rhodium on carbon catalyst. The autoclave is then sealed and pressurized at a pressure of 460-610 psig at a temperature in the range of 125°-150° C. for a period of 15 hours. The autoclave is then cooled down and opened and the reaction mass is filtered. The reaction mass is then distilled on a 14 inch Vigreux column yielding the following fractions:

| Fraction No. | Vapor Temp. (°C.) | Liquid Temp. (°C.) | Vacuum mm Hg Pressure | Weight of Fraction |
|---|---|---|---|---|
| 1 | 58 | 78 | 1.3 | 5.0 |
| 2 | 80 | 97 | 3.0 | 3.9 |
| 3 | 81 | 98 | 2.8 | 7.0 |
| 4 | 81 | 99 | 2.8 | 6.8 |
| 5 | 82 | 100 | 2.8 | 14.1 |
| 6 | 83 | 103 | 2.8 | 13.1 |
| 7 | 84 | 105 | 2.8 | 15.1 |
| 8 | 89 | 109 | 2.8 | 14.7 |
| 9 | 103 | 112 | 2.8 | 14.3 |
| 10 | 104 | 109 | 2.0 | 19.9 |
| 11 | 105 | 110 | 2.0 | 20.0 |
| 12 | 105 | 110 | 2.0 | 47.9 |
| 13 | 105 | 110 | 2.0 | 49.1 |
| 14 | 106 | 111 | 2.0 | 47.6 |
| 15 | 107 | 112 | 2.0 | 41.0 |
| 16 | 108 | 113 | 2.0 | 23.3 |
| 17 | 109 | 114 | 2.0 | 24.0 |
| 18 | 110 | 130 | 2.0 | 19.8 |
| 19 | 100 | 200 | 2.0 | 10.4 |
| 20 | 90 | 230 | 2.0 | 4.9 |

Fractions 12-15 are bulked for subsequent organoleptic utilization.

FIG. 5 is the GLC profile for bulked fractions 12-15 of the foregoing distillation (conditions: 10'×¼ inch, 10% carbowax column programmed at 80°-225° C. at 8° C. per minute).

FIG. 6 is the infra-red spectrum for bulked fractions 12-15.

FIG. 7 is the NMR spectrum for bulked fractions 12-15 of the foregoing distillation (solvent: $CFCl_3$; Field strength: 100 MHz).

EXAMPLE IV

PREPARATION OF ACETIC ACID ESTER OF 3,4,5,6,6-PENTAMETHYL HEPTANOL-2

Reaction:

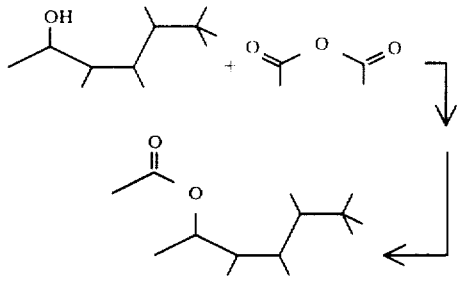

Into a one liter reaction flask equipped with reflux condenser, heating mantle, stirrer and thermometer is placed 205 grams of bulked distillation fractions 6-8 of the alcohol reaction product of Example III consisting essentially of the compound having the structure:

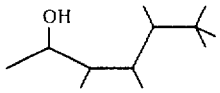

The reaction mass is heated to 100° C. Over a four-hour period 155 grams of acetic anhydride is added to the reaction mass while maintaining the reaction temperature at 100° C. The reaction mass is stirred for an additional five hours at 100° C. and then cooled to 60° C.

750 grams of water is then added to the reaction mass and the reaction mass is stirred at 50°-60° C. for another hour. The reaction mass now exists in two phases; an organic phase and an aqueous phase. The aqueous phase is extracted with 100 ml of toluene. The toluene extract and the organic phase are combined and washed with one 250 ml portion of water. The toluene solvent is then stripped off and the reaction mass is then distilled at 20 mm Hg pressure using a 14" Vigreux column yielding the following fractions:

| Fraction Number | Vapor Temp. (°C.) | Liquid Temp. (°C.) | Pressure mm/Hg | Reflux Ratio | Weight of Fraction (grams) |
|---|---|---|---|---|---|
| 1 | 89 | 105 | 20 | 4:1 | 17.4 |
| 2 | 94 | 112 | 20 | 4:1 | 18.8 |
| 3 | 115 | 122 | 20 | 4:1 | 18.9 |
| 4 | 117 | 124 | 20 | 4:1 | 21.9 |
| 5 | 119 | 121 | 20 | 4:1 | 12.4 |
| 6 | 119 | 122 | 20 | 4:1 | 14.6 |
| 7 | 119 | 122 | 20 | 4:1 | 18.3 |
| 8 | 120 | 123 | 20 | 4:1 | 16.7 |
| 9 | 120 | 124 | 20 | 4:1 | 17.9 |
| 10 | 125 | 131 | 20 | 4:1 | 17.2 |
| 11 | 118 | 146 | 20 | 4:1 | 19.2 |
| 12 | 117 | 208 | 20 | 4:1 | 6.2 |

FIG. 8 is the GLC profile for fraction 8 of the foregoing distillation containing the compound having the structure:

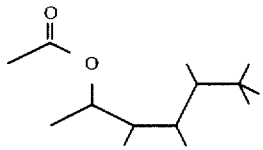

FIG. 9 is the NMR spectrum for fraction 8 of the foregoing distillation product containing the compound having the structure:

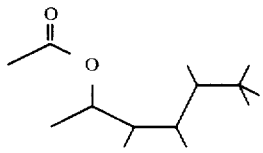

(Solvent: $CFCl_3$; Field strength: 100 MHz).

FIG. 10 is the infra-red spectrum for fraction 8 of the foregoing distillation product containing the compound having the structure:

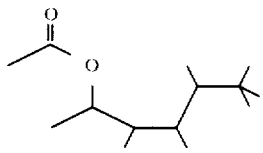

EXAMPLE V

PERFUME FORMULATION

The following vetiver perfume formulation is prepared:

| Ingredients | Parts by Weight |
|---|---|
| Vetivone | 25.0 |
| Compound having the structure: 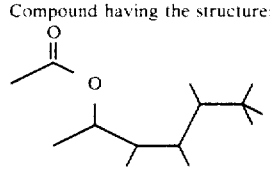 produced according to Example IV, bulked fractions 3-8 | 25.0 |
| Vetiverol | 5.0 |
| Musk ketone | 8.0 |
| Styrax essence | 12.5 |

The addition of the compound having the structure:

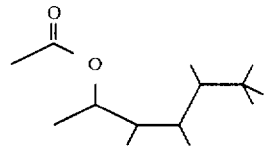

prepared according to Example IV imparts to this vetiver formulation a warm, sweet, woody, ambery, floral, piney, fruity and musky undertone.

EXAMPLE VI

PERFUMED LIQUID DETERGENT

Concentrated liquid detergents with aromas as described in Table I below (which detergents are produced from the lysine salt of n-dodecyl benzene sulfonic acid as more specifically described in U.S. Pat. No. 3,948,818 issued on Apr. 6, 1976) are prepared containing one of the substances set forth in Table I below. They are prepared by adding and homogeneously mixing the appropriate quantity of substance as indicated in Table I below. The detergents all possess aroma profiles as set forth in Table I below, the intensity increasing with greater concentrations of the composition of matter as set forth in Table I below:

TABLE I

| Aroma Ingredient | Aroma Profile |
|---|---|
| Secondary alcohol ester produced according to Example IV having the structure: 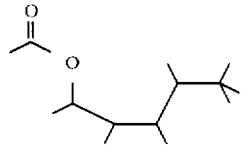 (bulked fractions 3-8) | A warm, sweet, woody, ambery, floral, piney, fruity and musky profile with ionone-like undertones. |
| Perfume composition of Example V | A vetiver aroma with warm, sweet, woody, ambery, floral, piney, fruity and musky undertones. |

EXAMPLE VII

PREPARATION OF A COLOGNE AND HANDKERCHIEF PERFUME

Aroma imparting and augmenting ingredients as defined according to Table I in Example VI are incorporated into colognes at concentrations of 1.5%, 2.0%, 2.5%, 3.0%, 4.0% and 5.0% in 75%, 80%, 80%, 90% and 95% solutions of aqueous ethanol; and into handkerchief perfumes at concentrations of 15%, 20%, 25% and 30% (in 80%, 85% and 95% aqueous ethanol solutions). The use of the compositions of matter as set forth in Table I of Example VI affords distinct and definitive aroma profiles as set forth in Table I of Example VI to the handkerchief perfumes and to the colognes.

EXAMPLE VIII

PREPARATION OF A SOAP COMPOSITION

One hundred grams of soap chips (IVORY ®) manufactured by the Procter & Gamble Company of Cincinnati, Ohio, are melted and intimately admixed with one of the aroma materials as set forth in Table I of Example VI supra, the amount of composition of matter of Table I of Example VI being one gram of each composition of matter. The conditions of mixing are: 180° C., 3 hours, 12 atmospheres pressure. At the end of the mixing cycle, while the soap is still under 12 atmospheres pressure, the mixture of soap and perfume ingredient is cooled to room temperature. At this temperature, the resulting mixture is in a solid state. The resulting soap block is then cut up into soap cakes. Each of the soap cakes manifests an excellent aroma as set forth in Table I of Example VI. None of the soap samples show any discoloration even after two weeks in the oven at 90° F.

EXAMPLE IX

PREPARATION OF A DETERGENT COMPOSITION

A total of 100 grams of a detergent powder (nonionic detergent powder containing a proteolytic enzyme prepared according to Example I of Canadian Pat. No. 985,190 issued on Mar. 9, 1976) is mixed with 0.15 grams of one of the compositions of matter as set forth in Table I of Example VI until a substantially homogeneous composition is obtained. Each of the compositions has excellent aroma profiles as set forth in Table I of Example VI.

EXAMPLE X

PERFUMED LIQUID DETERGENTS

Concentrated liquid detergents with rich, pleasant aromas as set forth in Table I of Example VI are prepared containing 0.10%, 0.15% and 0.20% of each of the compositions of matter set forth in Table I of Example VI. They are prepared by adding and homogeneously admixing the appropriate quantity of composition of matter of Table I of Example VI in the liquid detergent. The liquid detergents are all produced using anionic detergents containing a 50:50 mixture of sodium lauroyl sarcosinate and potassium N-methyl lauroyl tauride. The detergents all possess pleasant aromas as defined in Table I of Example VI, the intensity increasing with greater concentrations of composition of matter of Table I of Example VI.

EXAMPLE XI

TOBACCO FORMULATION

A tobacco mixture is prepared by admixing the following ingredients:

| Ingredients | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.3 |

Cigarettes are prepared from this tobacco.

The following flavor formulation is prepared:

| Ingredients | Parts by Weight |
|---|---|
| Ethyl butyrate | 0.05 |
| Ethyl valerate | 0.05 |
| Maltol | 2.00 |
| Cocoa extract | 26.00 |
| Coffee extract | 10.00 |
| Ethyl alcohol | 20.00 |
| Water | 41.90 |

The above stated tobacco flavor formulation is applied at the rate of 1.0% to all of the cigarettes produced using the above tobacco formulation. One-half of the cigarettes are then treated with 500–1000 ppm of the secondary alcohol ester defined according to the structure:

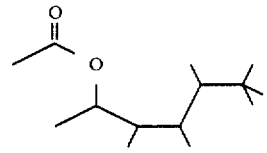

produced according to Example IV (bulked fractions 3–8).

The second half of the cigarettes are "control cigarettes" and do not contain any of the ester produced in Example IV but only contain untreated flavor formulation as set forth above. The control cigarettes and the treated experimental cigarettes are then evaluated by paired comparison and the results are as follows:

The experimental cigarettes are found to have more body and to be, on smoking, more Turkish tobacco-like, more aromatic and to have spicy and woody/oriental aroma and taste nuances in both the main stream and the side stream. These aroma nuances are missing from the control cigarettes. Prior to smoking, the experimental cigarettes have dry, woody, vetiver-like, musty and earthy nuances.

What is claimed is:

1. A process for augmenting or enhancing the aroma or taste of a consumable material selected from the group consisting of smoking tobaccos and smoking tobacco articles comprising the step of intimately admixing with a smoking tobacco composition or at least one element of a smoking tobacco article, an aroma or taste augmenting or enhancing quantity of at least one compound defined according to the structure:

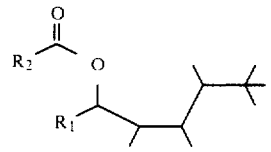

wherein $R_1$ is $C_1$-$C_3$ alkyl and $R_2$ is hydrogen or $C_1$-$C_3$ alkyl.

2. The process of claim 1 wherein the consumable material is a smoking tobacco.

3. The process of claim 1 wherein the consumable material is a smoking tobacco and the compound defined according to the structure:

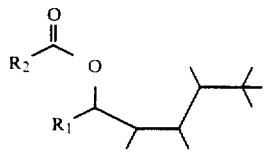

is in intimate contact with at least a portion of said smoking tobacco article.

4. A process for augmenting or enhancing the aroma or taste of a consumable material selected from the group consisting of smoking tobacco compositions and smoking tobacco articles comprising the step of intimately admixing with a smoking tobacco composition or at least one element of a smoking tobacco article an aroma or taste augmenting or enhancing quantity of a product produced according to a process comprising the step of treating with hydrogen in the presence of a catalyst selected from the group consisting of Raney nickel and rhodium at least one compound defined according to the structure:

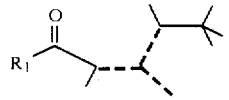

wherein in the compound having the structure:

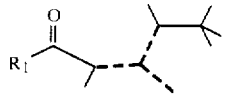

one of the dashed lines is a carbon-carbon double bond and each of the other of the dashed lines are carbon-carbon single bonds at a temperature in the range of from 100° C. up to 200° C. and at a pressure in the range of from 400 psig up to 1400 psig and then reacting the product which consists essentially of compounds defined according to the structure:

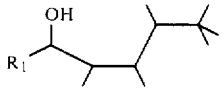

with formic acid, where $R_2$ is hydrogen or an acyl anhydride having the structure:

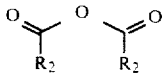

and $R_1$ is $C_1$-$C_3$ alkyl and wherein $R_2$ is $C_1$-$C_3$.

5. The process of claim 4 wherein $R_1$ is methyl and $R_2$ is methyl.

6. The process of claim 4 wherein the consumable material is a smoking tobacco composition.

7. The process of claim 4 wherein the consumable material is a smoking tobacco article component.

* * * * *